US008726539B2

(12) United States Patent
Potter et al.

(10) Patent No.: US 8,726,539 B2
(45) Date of Patent: May 20, 2014

(54) HEATER AND CONTROLS FOR EXTRACTION OF MOISTURE AND BIOLOGICAL ORGANISMS FROM STRUCTURES

(71) Applicants: Gary J. Potter, Marthasville, MO (US); Marc Braun, St. Louis, MO (US); Jeffrey A. Kieffer, Tulsa, OK (US)

(72) Inventors: Gary J. Potter, Marthasville, MO (US); Marc Braun, St. Louis, MO (US); Jeffrey A. Kieffer, Tulsa, OK (US)

(73) Assignee: Cambridge Engineering, Inc., Chesterfield, MO (US)

( * ) Notice: Subject to any disclaimer, the term of this patent is extended or adjusted under 35 U.S.C. 154(b) by 88 days.

(21) Appl. No.: 13/573,493

(22) Filed: Sep. 18, 2012

(65) Prior Publication Data

US 2014/0075776 A1 Mar. 20, 2014

(51) Int. Cl.
*F26B 3/02* (2006.01)

(52) U.S. Cl.
USPC ..... 34/427; 34/474; 34/90; 34/213; 62/278; 165/54; 43/132.1

(58) Field of Classification Search
USPC ..... 34/380, 381, 413, 427, 474, 497, 513, 34/90, 201, 213; 62/271, 278; 165/53, 54; 43/112, 132.1
See application file for complete search history.

(56) References Cited

U.S. PATENT DOCUMENTS

| | | | | |
|---|---|---|---|---|
| 923,368 A | | 6/1909 | Myser | |
| 1,885,854 A | | 11/1932 | Montellano | |
| 1,991,222 A | * | 2/1935 | Laib | 34/569 |
| 2,114,494 A | | 4/1938 | Hummel et al. | |
| 2,171,315 A | | 8/1939 | Rennerfelt | |
| 2,559,107 A | | 7/1951 | Bloxham | |
| 2,983,500 A | | 5/1961 | Finley | |
| 3,056,214 A | * | 10/1962 | Andersen, Jr. | 34/530 |
| 3,486,693 A | | 12/1969 | McMann et al. | |
| 3,614,074 A | | 10/1971 | Wellford, Jr. | |
| 3,638,858 A | | 2/1972 | Alms | |

(Continued)

FOREIGN PATENT DOCUMENTS

| | | | |
|---|---|---|---|
| CN | 2013 28754 | * | 10/2009 |
| DE | 3338848 A1 | | 5/1985 |

(Continued)

OTHER PUBLICATIONS

M.Nicholson, W.Von Rotberg,Controlled Environment Heat Treatment As a Safe and Efficient Method of Pest Control, Second International Conference on Urban Pests,263-265(1996).

(Continued)

*Primary Examiner* — Steve M Gravini
(74) *Attorney, Agent, or Firm* — Paul M. Denk

(57) ABSTRACT

A gas heater with specialized controls allows an operator to deploy a single device to heat and to dry when extracting moisture from a structure. The heater has a fan in a blow thru arrangement ahead of a burner. The burner uses either natural gas or liquefied petroleum gas. The heater has air flow, fan motor, temperature, and ignition controls and sensors. The heater delivers high temperature air to the structure that hastens evaporation as the heated air absorbs great concentrations of water vapor. Then the moisture laden heated air exits the building as the heater draws in fresh air, ducts it into a structure, and pressurizes the structure. This moisture laden air then leaks from the building through select windows using the energy imparted from the fan and then exhausts the moisture to the atmosphere, drying the structure.

18 Claims, 12 Drawing Sheets

Graph 2: Moisture Extracted in Relationship with Moisture Added from the Heater and Outside Air

(56) References Cited

U.S. PATENT DOCUMENTS

| | | | |
|---|---|---|---|
| 3,742,535 | A | 7/1973 | Horrer et al. |
| 3,750,327 | A | 8/1973 | Thybault |
| 3,782,026 | A | 1/1974 | Bridges et al. |
| 3,814,569 | A | 6/1974 | Jacobsz |
| 3,846,072 | A | 11/1974 | Patterson |
| 4,205,381 | A | 5/1980 | Games et al. |
| 4,268,247 | A | 5/1981 | Freze |
| 4,269,171 | A | 5/1981 | McArthur |
| 4,482,312 | A | 11/1984 | Cade |
| 4,513,910 | A | 4/1985 | Bartels |
| 4,517,329 | A | 5/1985 | Mottus |
| 4,558,523 | A | 12/1985 | Isbell et al. |
| 4,597,192 | A | 7/1986 | Sfondrini et al. |
| 4,618,497 | A | 10/1986 | Couey |
| 4,676,152 | A | 6/1987 | Tsuji et al. |
| 4,696,223 | A | 9/1987 | Link et al. |
| 4,716,676 | A | 1/1988 | Imagawa |
| 4,817,329 | A | 4/1989 | Forbes |
| 4,823,520 | A | 4/1989 | Ebeling et al. |
| 4,852,524 | A | 8/1989 | Cohen |
| 4,864,942 | A | 9/1989 | Fochtman et al. |
| 4,902,315 | A | 2/1990 | Spicer |
| 4,953,320 | A | 9/1990 | Nelson |
| 4,958,456 | A | 9/1990 | Chaudoin et al. |
| 4,959,456 | A | 9/1990 | Ashida et al. |
| H828 | H | 10/1990 | Armstrong et al. |
| 4,961,283 | A | 10/1990 | Forbes |
| 4,989,363 | A | 2/1991 | Doermemann |
| 5,022,165 | A | 6/1991 | Beswick |
| 5,030,423 | A | 7/1991 | Obee et al. |
| 5,041,298 | A | 8/1991 | Wallace et al. |
| 5,058,313 | A | 10/1991 | Tallon |
| 5,069,618 | A | 12/1991 | Nieberding |
| 5,096,474 | A | 3/1992 | Miller et al. |
| 5,109,916 | A | 5/1992 | Thompson |
| 5,120,512 | A | 6/1992 | Masuda |
| 5,184,419 | A | 2/1993 | Tallon |
| 5,192,343 | A | 3/1993 | Henry |
| 5,203,108 | A | 4/1993 | Washburn |
| 5,219,226 | A | 6/1993 | James |
| 5,225,167 | A | 7/1993 | Wetzel |
| 5,244,480 | A | 9/1993 | Henry |
| 5,272,799 | A | 12/1993 | Sato |
| 5,276,980 | A | 1/1994 | Carter et al. |
| 5,340,406 | A | 8/1994 | Fearon |
| 5,349,778 | A | 9/1994 | Chu |
| 5,369,892 | A | 12/1994 | Dhaemers |
| 5,387,403 | A | 2/1995 | Ikeuchi et al. |
| 5,403,597 | A | 4/1995 | Mueller |
| 5,416,727 | A | 5/1995 | Shook et al. |
| 5,442,876 | A | 8/1995 | Pedersen |
| 5,468,938 | A | 11/1995 | Roy |
| 5,471,782 | A | 12/1995 | Brittell |
| 5,491,092 | A | 2/1996 | Colvin |
| 5,501,032 | A | 3/1996 | Pitman |
| 5,536,353 | A | 7/1996 | Fonseca |
| 5,572,799 | A | 11/1996 | Masuyuki |
| 5,578,274 | A | 11/1996 | Seidner |
| 5,590,830 | A | 1/1997 | Kettler et al. |
| 5,607,711 | A | 3/1997 | Lagunas-Solar |
| 5,634,786 | A | 6/1997 | Tillander |
| 5,678,352 | A | 10/1997 | Leitner et al. |
| 5,692,680 | A | 12/1997 | Harwath et al. |
| 5,730,591 | A | 3/1998 | Robertson et al. |
| 5,752,323 | A | 5/1998 | Hashimoto et al. |
| 5,761,908 | A | 6/1998 | Oas et al. |
| 5,768,907 | A | 6/1998 | Lee |
| 5,792,419 | A | 8/1998 | Williamson |
| 5,806,238 | A | 9/1998 | Brenner |
| 5,837,040 | A | 11/1998 | Caughron et al. |
| 5,881,681 | A | 3/1999 | Stuart |
| 5,924,859 | A | 7/1999 | Nolte et al. |
| 5,960,558 | A | 10/1999 | Bourgault |
| 5,968,401 | A | 10/1999 | Roy |
| 5,972,467 | A | 10/1999 | Washo |
| 5,979,472 | A | 11/1999 | Lowery et al. |
| 6,032,474 | A | 3/2000 | Dale et al. |
| 6,050,025 | A | 4/2000 | Wilbanks |
| 6,141,901 | A | 11/2000 | Johnson et al. |
| 6,146,600 | A | 11/2000 | Williamson |
| 6,162,393 | A | 12/2000 | De Bruiju et al. |
| 6,171,561 | B1 | 1/2001 | Williamson et al. |
| 6,199,770 | B1 | 3/2001 | King et al. |
| 6,279,261 | B1 | 8/2001 | Binker |
| 6,327,812 | B1 | 12/2001 | Hedman |
| 6,342,085 | B1 | 1/2002 | Giroux |
| 6,442,890 | B1 | 9/2002 | Creeger et al. |
| 6,447,737 | B1 | 9/2002 | Williamson et al. |
| 6,451,152 | B1 | 9/2002 | Holmes et al. |
| 6,530,172 | B2 | 3/2003 | Lenz |
| 6,568,124 | B1 | 5/2003 | Wilbanks |
| 6,588,140 | B1 | 7/2003 | Johnson et al. |
| 6,594,946 | B2 | 7/2003 | Nolen et al. |
| 6,612,067 | B2 | 9/2003 | Topp |
| 6,652,628 | B1 | 11/2003 | Hess |
| 6,675,528 | B2 | 1/2004 | Jablin |
| 6,678,994 | B2 | 1/2004 | Topp |
| 6,699,433 | B2 | 3/2004 | Weinberg et al. |
| 6,772,829 | B2 | 8/2004 | Le Brun |
| 6,892,491 | B2 | 5/2005 | Hedman |
| 6,955,786 | B2 | 10/2005 | Carmen et al. |
| 7,022,167 | B2 | 4/2006 | Hess |
| 7,076,887 | B1 * | 7/2006 | Camberos ..... 34/90 |
| 7,076,915 | B1 | 7/2006 | Brooks et al. |
| 7,153,471 | B2 | 12/2006 | Weinberg et al. |
| 7,234,268 | B2 | 6/2007 | Welch |
| 7,247,090 | B2 | 7/2007 | Vacek |
| 7,284,383 | B2 | 10/2007 | Hess |
| 7,284,384 | B2 | 10/2007 | Hess |
| 7,284,385 | B2 | 10/2007 | Hess |
| 7,284,386 | B2 | 10/2007 | Hess |
| 7,284,387 | B2 | 10/2007 | Hess |
| 7,334,938 | B2 | 2/2008 | Remsburg |
| 7,357,831 | B2 | 4/2008 | Dancey et al. |
| 7,361,304 | B2 | 4/2008 | McVey et al. |
| 7,363,746 | B2 | 4/2008 | Spies et al. |
| 7,369,955 | B2 | 5/2008 | Lee |
| 7,382,269 | B2 | 6/2008 | Remsburg |
| 7,407,624 | B2 | 8/2008 | Cumberland et al. |
| 7,568,908 | B2 | 8/2009 | Potter |
| 7,690,148 | B2 | 4/2010 | Hedman |
| 7,966,741 | B2 | 6/2011 | Gorbell |
| 2001/0004813 | A1 | 6/2001 | Hedman |
| 2002/0066223 | A1 | 6/2002 | Hedman |
| 2002/0189154 | A1 | 12/2002 | Hedman |
| 2003/0029054 | A1 | 2/2003 | Cressy et al. |
| 2003/0100465 | A1 | 5/2003 | Kilkenny et al. |
| 2003/0129082 | A1 | 7/2003 | Weinberg et al. |
| 2003/0143108 | A1 | 7/2003 | Wasinger |
| 2003/0230477 | A1 | 12/2003 | Fink et al. |
| 2004/0028554 | A1 | 2/2004 | Hedman |
| 2004/0028583 | A1 | 2/2004 | Hedman |
| 2004/0148795 | A1 | 8/2004 | Bernon et al. |
| 2004/0184950 | A1 | 9/2004 | McVey et al. |
| 2005/0013727 | A1 | 1/2005 | Hedman |
| 2005/0108920 | A1 | 5/2005 | Takenoshita et al. |
| 2005/0220662 | A1 | 10/2005 | Hedman |
| 2005/0246942 | A1 | 11/2005 | Mueller et al. |
| 2005/0268543 | A1 | 12/2005 | Hicks et al. |
| 2006/0064891 | A1 | 3/2006 | Hess |
| 2006/0112588 | A1 | 6/2006 | Ness et al. |
| 2006/0137530 | A1 | 6/2006 | Yeager et al. |
| 2006/0185819 | A1 * | 8/2006 | Bourgault et al. ..... 165/47 |
| 2006/0189270 | A1 | 8/2006 | Bourgault et al. |
| 2007/0006815 | A1 | 1/2007 | Correa et al. |
| 2007/0084105 | A1 | 4/2007 | Lindsey et al. |
| 2007/0256318 | A1 | 11/2007 | Sugawara |
| 2007/0283986 | A1 | 12/2007 | Baum |
| 2007/0294956 | A1 | 12/2007 | Sugawara |
| 2008/0014111 | A1 | 1/2008 | Hedman |
| 2008/0127548 | A1 | 6/2008 | Chen et al. |
| 2008/0148624 | A1 | 6/2008 | Borth et al. |

(56) References Cited

U.S. PATENT DOCUMENTS

| | | | | |
|---|---|---|---|---|
| 2010/0024244 | A1* | 2/2010 | Potter | 34/474 |
| 2011/0302802 | A1 | 12/2011 | Wiseman et al. | |
| 2012/0080363 | A1* | 4/2012 | Evanovich et al. | 210/86 |

FOREIGN PATENT DOCUMENTS

| | | | | |
|---|---|---|---|---|
| DE | 3338848 | A1 | | 5/1985 |
| DE | 4025828 | A1 | | 2/1992 |
| DE | 4025828 | A1 | | 2/1992 |
| DE | 4205459 | | | 8/1993 |
| DE | 4205459 | A1 | | 8/1993 |
| DE | 4308585 | A1 | | 9/1994 |
| DE | 4308585 | A1 | | 9/1994 |
| EP | 676138 | A1 | | 11/1995 |
| EP | 676138 | A1 | | 11/1995 |
| EP | 927862 | | | 7/1999 |
| GB | 2 026 552 | | * | 2/1980 |
| JP | 56-3823 | | | 1/1981 |
| JP | 60-64125 | | | 4/1985 |
| JP | 62006631 | A | | 1/1987 |
| JP | 2187115 | | | 7/1990 |
| JP | 2008-119159 | | * | 5/2008 |
| WO | WO 8103695 | A1 | | 12/1981 |
| WO | WO 97/30802 | | | 8/1997 |

OTHER PUBLICATIONS

David Pinniger, Insect Conrtol with the Thermo Lignum Treatment, 59 Conservation News (Mar. 1996).
Dean,Heat as a Means of Controlling Mill Insects, 4J. Econ. Entomology, 142-61 (1911).
O'Kane and Osgood, Studies in Termite Control, 6 and 14.
Insect Control in Flour Mills,U.S. Dept. Of Agriculture, 23-24 (1958).
Simon and Schuster, The Way Things Work, 248-249; 262-63; 265 (1967).
Elsworth, Treatment of Process Air for Deep Culture, Methods of Microbiology, pp. 123-135 (1969).
The Effect of Air Control Systems on the Indoor Distributions of Viable Particles, 8 Env'tl In'l, 409-14 (1982).
Kenneth O. Sheppard, Heat Sterilization (Superheating) as a Control for Stored-Grain Pests in a Food Plant, Insect Management for Food Storage and Processing,199-200 (1984).
Charles C. Forbes, Walter Ebeling,Updated:Use of Heat for Elimination of Structural Pests,vol. 9 IMP Practitioner No. 8 (Aug. 1987).
Ebeling, et al., Heat Treatment of Powderpost Beetles, 9 IPM Practitioner 1 (Sep. 1989).
Brand & Kadrey,The Chronicle Whole Earth Catalog Briefing: Safe Homes/The Toxic-Free House, p. 2.
Walter Ebeling, Thermal Pest Eradication System for Structural Pest Control, vol. 16 IPM Practitioner No. 2 (Aug. 1994)p. 1-4;6-7.
Jerry Heaps, Heat for Stored Product Insects, 18 IPM Practitioner 18 (May 1996).
Ebeling, Expanded Use of Thermal Pest Eradication (TPE), 19 IPM Practitioner 1 (Aug. 1997),p. 1-3; 5; 8
Rust,Michael K. & Donald A. Reirson,Sensitivity in Insects and Application in Integrated Pest Management,Westview Press,179 (G.J. Hallmann & D. L. Denlinger eds.(1998), p. 179;195.
Dri-Eaz Products, Inc., Save Time and Reduce Costs on Water Damage Claims Using Dr-Eaz 750 Mobile Desiccant Dumidifier (1988) p. 2 and p. 4.
Dr. Michael A. Berry, Protecting the Built Environment: Cleaning for Health (1993), pp. 56-57; 81; 94-95; 133-135; 169.
M.Nicholson, W.Von Rotberg,Controlled Environment Heat Treatment As a Safe and Efficient Method of Pest Control,Second International Conference on Urban Pests,1996,pp.263-265.
David Pinniger, Insect Control with the Thermo Lignum Treatment,Conservation News No. 59, Mar. 1996, pp. 1-3.
George Dean,Heat as a Means of Controlling Mill Insects, Journal of Economic Entomology, 1911, pp. 142-161, vol. 4.
W.C. O'Kane and W.A. Osgood, Studies in Termite Control, New Hampshire Dept. of Entomology,Bulletin 204, Apr. 1922, pp. 1-20.
Insect Control in Flour Mills, U.S. Dept. of Agriculture, Handbook 133, Feb. 1958, pp. 23-25.
Simon and Schuster, The Way Things Work,1967, pp. 248-249; 262-265.
R. Elsworth, Treatment of Process Air for Deep Culture, Methods in Microbiology, 1969, pp. 123-133, vol. 1, Chapter 4.
David Sterling, C.Clark, S. Bjornson,The Effect of Air Control Systems on the Indoor Distributions of Viable Particles,Environment Intenationa1,1982, pp. 409-414,vol. 8.
Kenneth O. Sheppard, Heat Sterilization (Superheating) as a Control for Stored-Grain Pests in a Food Plant, Insect Management for Food Storage and Processing,1984,pp. 193-200.
Charles C. Forbes,Walter Ebeling,Update:Use of Heat for Elimination of Structural Pests,IMP Practitioner, Aug. 1987, pp. 1-5, vol. 9, No. 8.
Walter Ebeling, et al., Heat Treatment for Powderpost Beetles, IPM Practitioner,Sep. 1989, pp. 1-4, vol. 11, No. 9.
Brand & Kadrey,The Chronicle Whole Earth Catalog Briefing: Safe Homes/The Toxic-Free House, San Francisco Chronicle, 1991, pp. 1-3.
Walter Ebeling, The Thermal Pest Eradication System for Structural Pest Control, IPM Practitioner, Feb. 1994, pp. 1-7, vol. 16, No. 2.
Jerry Heaps, Heat for Stored Product Insects, IPM Practitioner, May 1996 pp. 18-19,vol. 18.
Walter Ebeling, Expanded Use of Thermal Pest Eradication (TPE),IPM Practitioner, Aug. 1997, pp. 1-8, vol. 19, No. 8.
Michael K. Rust & Donald A. Reirson,Temperature Sensitivity in Insects and Application in Integrated Pest Management, Westview Press,1998, pp. 179-200.
Save Time and Reduce Costs on Water Damage Claims Using Dri-Eaz 750 Mobile Desiccant Dehumidifier, DRI-EAZ Products, Inc. ,1988, pp. 1-4.
Michael A. Berry, Ph.D., Protecting the Built Environment: Cleaning For Health, 1993, pp. 56-57; 81; 94-95; 133-135; 169.

* cited by examiner

Graph 1: Example for a Dryout System Utilizing a Direct Fired Heater

Graph 2: Moisture Extracted in Relationship with Moisture Added from the Heater and Outside Air Graph 3: Dryout System with Direct Fired Heater

HEATER AND CONTROLS FOR EXTRACTION OF MOISTURE AND BIOLOGICAL ORGANISMS FROM STRUCTURES

CROSS-REFERENCE TO RELATED APPLICATION

This continuation patent application claims priority to the continuation-in-part patent application having Ser. No. 12/460,648, filed on Jul. 22, 2009, now Publication No. 2010/0024244; which claims priority to the non-provisional patent application having Ser. No. 10/223,556, filed on Aug. 19, 2002, now U.S. Pat. No. 7,568,908; which claims priority to the continuation patent application having Ser. No. 09/574,338, filed on May 20, 2000, now abandoned; which claims priority to the provisional patent application having Ser. No. 60/135,067, filed on May 20, 1999, now expired; which are owned by the same inventor.

BACKGROUND OF THE INVENTION

Burners of various kinds and strengths combust outside air and supplied fuel to produce heat. Adding heat to a building often dries the remaining air inside a building. In drying the building air, moisture can be extracted from a building as during remediation from a flood, a fire suppression event, and cleaning activities to name a few. The water dryout industry has long held the erroneous premise that direct gas fired heaters should not be utilized for dryout of flooded buildings because of the heaters adding moisture into the air within a building as a residual from the combustion process. Although moisture is released as part of the combustion process, the amount of water created is relatively small when compared to the volume of dilution air that is provided with a direct fired heater. The combustion process produces 0.095 pounds of water per cubic foot of natural gas. So, the opponents against utilizing direct fire heaters for dryout applications focus on the 95 pounds of water that a 1 million Btu per hour heater produces every hour.

Within the dryout industry, opponents of heater usage overlook the dilution aspect of the fresh outside air being supplied by the direct fired heater. A one million Btu/hr heater operating at a 140° F. temperature rise and delivering 6,000 cfm will convey over 27,000 pound of air (6000 cfm×60 min/hr×0.075 lb/cf (air density handled by the blower)) while producing the 95 pounds of water vapor. This equates to 0.0035 pounds of water per pound of dry air and when added to the moisture present in the fresh outdoor air, the heated discharge air has typically less than 2% relative humidity, or RH, and thus is very dry or almost desert like.

As an example of the limited amount of water vapor added by combustion to air within a building, consider that outdoor air at 40° F. and 60% RH has an air density of 0.0794 pounds per cubic foot and a moisture content of 0.00314 pounds of moisture per pound of dry air or 22 grains of moisture per pound of dry air. When this outdoor air is heated to a discharge temperature 180° F. following combustion, the fuel gas consumed by combustion will be 1,047,638 Btu/hr (from 6000 cfm×0.0794 lb/cf×0.241×60 min/hr×140/0.92) resulting in 99.5 pounds of water vapor. This equates to 0.0035 pounds of moisture per pound of dry air (from 99.5/(6,000×60×0.0794)) or 24.4 grains of moisture per pound of dry air. The fresh outside air heated to 180° F. and delivered to the building being treated contains 0.0066 pounds of moisture per pound of dry air or 46.4 grains of moisture per pound of dry air. From a high temperature psychometric chart, this point of combustion, 180° F. at 0.0066 pounds of moisture per pound of dry air, indicates a relative humidity of below 2%.

Direct gas-fired industrial air heaters are used extensively to provide replacement air to match air that is exhausted or to provide ventilation air in industrial and commercial occupancies. These heaters typically operate around the clock, year round, and it is therefore important to minimize the temperature rise of these heaters during mild weather operation so as not to overheat the space. With the airflow held constant as is the case with most make-up air heater applications, the minimum temperature rise relates to the minimum gas flow rate.

For burner systems which ignite a pilot light and establish a proper flame signal for the pilot prior to energizing the main burner gas valves, the ignition of the main burner gas is readily accomplished even at the minimum fire condition. In the industry this type of ignition system is referred to as an "intermittent pilot ignition system." These systems have generally required only one input for supervising or monitoring the presence of flame and that sensor is typically located in close proximity to the pilot flame so as to sense its presence. In some ignition systems, gas flow to the pilot burner would be shut off after adequate time had expired for establishing the main burner flame, thereby having the flame sense circuit actually sense the main burner flame once the pilot flame had extinguished itself. This type of ignition system is referred to as an "interrupted pilot ignition system."

Direct ignition systems are another means for lighting the main burner gas. However, the present invention omits a pilot system. Ignition of the main burner occurs immediately after the main gas valve is energized. There is a variation of this type of ignition system which may be referred to as a "proven source" type of direct ignition system where current flow to the ignition device is confirmed to be functioning properly prior to opening the main burner gas valve. All of the above ignition systems have functioned with equal reliability for many years in millions of different heating appliances.

A properly designed direct ignition system in a direct gas-fired industrial air heater or make-up air heater application is most difficult or challenging from an engineering standpoint because this system must ignite the main burner over an extremely wide range of gas flow rates. To contemplate this aspect of the application challenge in a more detailed manner, one needs to understand that the ignition source, whether it is a high voltage spark or a hot surface ignition device, is generally only present for a few seconds and can be extremely small with respect to the size of burner that it is being utilized on. Gas flow must reach the area of the burner where the ignition source is located with the proper fuel to air ratio to obtain ignition.

During the development of the Harmonized Standard for Direct Gas-Fired Industrial Air Heaters between the United States and Canada, a provision was added that required the main burner flame supervision means for burners over 36 inches in length to be as remote as possible from the ignition source to ensure flame propagation has occurred and is maintained over the entire length of burner. To accommodate this requirement in pilot ignition type systems, a second flame detection device can been employed along with the associated controls which switches the pilot sensing system to the main burner flame sense controls after a preset time delay which allows for the flame to propagate across the burner length.

The impact of this provision cause more problems for direct ignition systems with regard to ignition at the minimum fire condition and the time required for that small flame to propagate across the full length of the burner. The flame establishment time period typically only last for only a few seconds after energizing the main gas shut-off valves. The ANSI standard limits the flame establishing time period to a maximum of 15 seconds for direct ignition systems with burners over rated 400,000 Btu/hr and thus, the manufacturer would desire to keep this time as short as possible. Direct fired heaters are not vented and in the case of a delayed or failed ignition, raw gas is dumped into the space being heated. Though the actual quantity of gas may be small and not pose an unsafe condition for the building or its occupants, the noticeable odor from the gas, mercaptan, may unnecessarily incite an adverse reaction to the occupants of a building.

Without one of the control methodology provided as the basis for this invention, the minimum gas flow adjustment would have to be significantly increased or other more expensive gas flow controls systems is employed for direct ignition type systems to ensure that the flame would propagate across the burner within the flame establishment time period. Longer burners would require a higher minimum fire adjustment to account for the distance that the flame has to travel. Increasing the minimum gas flow rate also increases the minimum temperature which then unfortunately overheats the conditioned space during mild weather.

DESCRIPTION OF THE PRIOR ART

The solution, supported by the portion of the dryout industry that uses heat, focuses on either indirect fired heaters that is with a heat exchanger or boilers that circulate a hot fluid through piping to room heat exchangers to warm the building for dryout purposes. Both of these have significantly less energy efficiency than the direct fired heater. In addition, these solutions rely on dehumidifiers and portable blowers in rooms within a structure to accelerate in the extraction of moisture from a flooded building during the heating process. Even used together, these systems take a considerable amount of time to dry the structure.

The basis of the prior art process provides heat along with air movement to accelerate the evaporation of moisture from within the flooded building. Once the moisture evaporates from the building materials into the nearby air, the dehumidifiers remove the moisture from the air by condensing it and then drains or pumps move the condensed water to the nearest outlet.

In the gas train of a direct gas-fired heater, with the modulating valve de-energized, the gas flow through the modulating valve is adjusted to obtain a minimum flow rate through a bypass circuit provided internal to the modulating valve. It is not unusual to obtain a three to five degree temperature rise as the minimum rise. The basis for determining the minimum temperature rise is that the flame burns over the entire length of burner and that the flame length is long enough to be detected by the flame sense circuit.

Maxitrol Company, Inc., of Southfield, Mich., manufactures a modulating valve and other associated controls that drive the modulating valve electrically from minimum fire to high fire and settings in between as a function of the discharge temperature of the heater and/or space temperature of the facility being served by the industrial air heater.

In addition, insurance underwriters require this type of equipment, specifically Industrial Risks Insurers, which indicates that ignition and the initial firing rate be limited as defined by the term "Low Fire Start". General practice of the industry has been to utilize a slow opening (typically a hydraulic operated motor) safety shutoff valve to accomplish a delay in achieving the full firing rate. An alternate means for accomplishing the Low Fire Start had been developed by the manufacturer of the modulating control system, Maxitrol, Inc., which involves removing all power from the modulating valve during ignition for a short time with a typical delay lasting for ten to thirty seconds. This condition yields a minimum fire start attempt which cause the problems and issues as described above.

SUMMARY OF THE INVENTION

A direct-fired heater of this invention with its specialized controls provides much to the dryout industry in its never ending struggle to dry structures. This invention allows an operator to rely upon one appliance to perform the heating and drying tasks rather than depend on two separate appliances for heating and for extracting the moisture from the space. Room circulating blowers assist in distributing the heated and dried air throughout the facility undergoing remediation by homogeneously mixing the air and by blowing the heated high velocity air across any damp surfaces to aid in the evaporation and moisture extraction processes. The high discharge temperature air delivered to the structure hastens evaporation and has a tremendous ability to absorb water vapor and the volume of air then carries the water vapor out of a building with the purged air. Purging occurs because the heater draws in fresh outside air, ducts it into the space following heating, and slightly pressurizes the structure. This air then leaks, or exfiltrates, from the building through exterior openings, as shown in FIG. 1, using solely the energy imparted from the heater fan and then exhausts the moisture to the atmosphere that it collected from within the building.

BRIEF DESCRIPTION OF THE DRAWINGS

In referring to the drawings.

The same reference numerals refer to the same parts throughout the various figures.

DESCRIPTION OF THE PREFERRED EMBODIMENT

Figure 1:
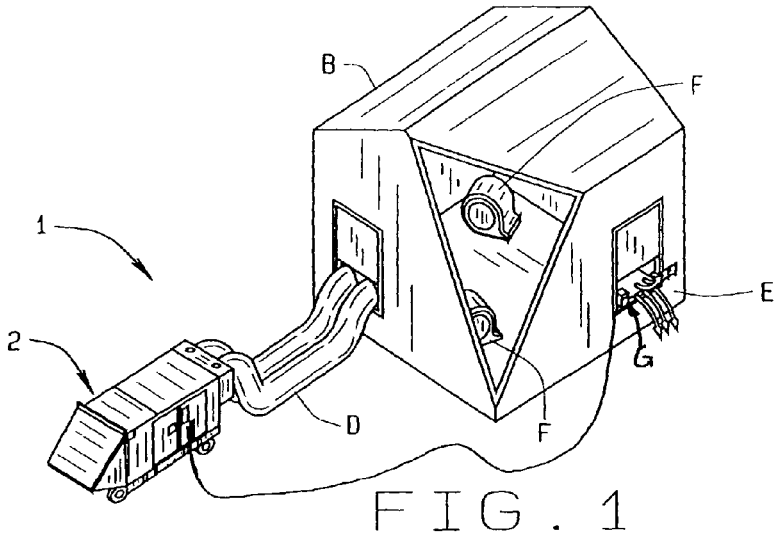
FIG. 1 provides an isometric view of the present invention deployed on a jobsite.

The present invention 1 overcomes the prior art limitations by providing a heater 2 and related controls that removes moisture and biological organisms from within a structure, such as a building B as shown in FIG. 1. The heater provides dry air, of low relative humidity, into a structure where the moisture from within the structure moves into the dry air seeking equilibrium. The heater does not produce noxious or toxic byproducts for introduction into a structure. Though the heater introduces water vapor from combustion, the heated air expands and allows for carrying of additional moisture from the structure. The heater produces dry air that removes moisture without damaging the wood and other building materials of the structure.

A direct-fired heater that utilizes the unique configuration of this invention and the specialized controls discussed herein offers much to the dryout industry. This device allows the operator to rely upon one device that heats and dries rather than depend on two separate appliances, one for heating and another for extracting the moisture from the structure. Room circulating blowers F would be utilized to assist in distributing the heated air throughout the structure. By being treated by homogeneously mixing the air and by blowing the heated air at high velocity across the damp surfaces to accelerate the evaporation and moisture extraction processes. The high discharge temperature air delivered to the structure hastens the evaporation process and has a tremendous ability to absorb water vapor and carry it out of the structure along with the air that is being purged, as at E. Purging occurs because the heater draws in fresh outside air and that air is ducted, as at D, into the structure after it is heated, slightly pressurizing the structure. This air then exfiltrates from the structure through exterior openings using solely the energy from the heater 2 along with the moisture it collected as it passed through the structure.

FIG. 1 shows the configuration of a simplified structure where the direct gas fired heater 2 connects to flexible ducting with outside air being heated and delivered to the structure. The building is treated as a mixing box with high volume circulating air fans blowing the heated air across the floor and wiping the adjacent walls, causing a turbulent mixture of the heated air with the moisture that is evaporating because of the combination of heat and the high velocity air. The delivered air applies a slightly positive pressure on the structure which moves the air to the opened window for controlled egress. The remote temperature controller, as at G, monitors the temperature of the room or the air exfiltrating the structure and as the desired indoor temperature setpoint nears, it provides feedback to a modulation control system to decrease the discharge temperature as required, maintaining the room temperature as selected.

Figure 2:
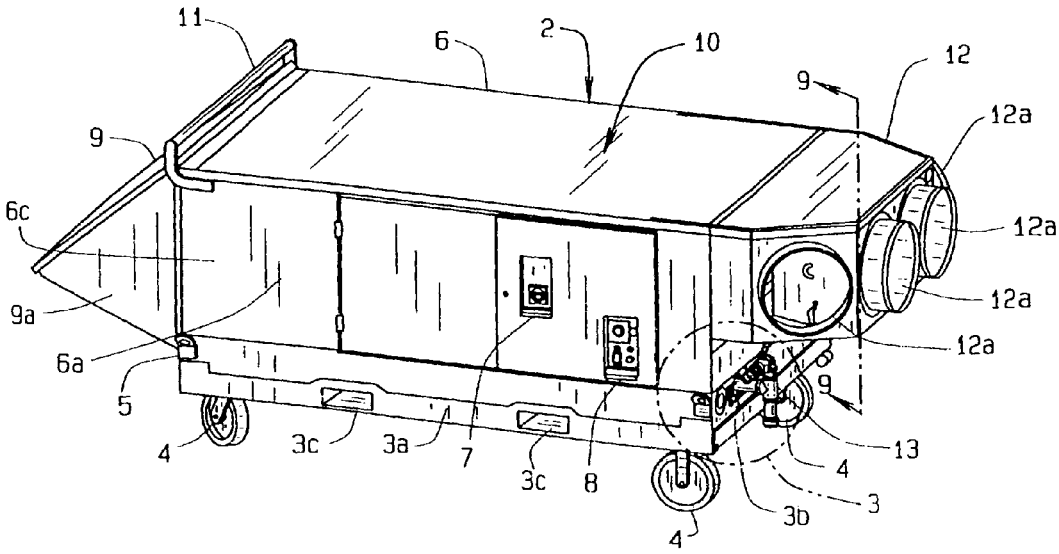
FIG. 2 shows an isometric view of the present invention.

Looking more closely, FIG. 2 provides an isometric view of a heater 2 as seen by an operator. The heated begins with a generally rectangular frame 3 that has two parallel spaced apart longitudinal sides 3*a* and two parallel spaced apart lateral ends 3*b* where the ends are perpendicular to the sides. The sides and ends assemble into a prismatic, box like shape. The sides also include at least two pockets 3*c* that receive the tine or forks from a forklift or other material handling equipment. The frame has a caster 4 located at each corner defined by the intersection of a side and an end where the preferred embodiment has four casters. Alternatively, the frame has at least one track beneath each side for more rugged usage of the invention. Above the casters, the frame includes at least one lift eye 5 at each corner. The main body 6 of the heater 2 has a generally elongated rectangular shape and rests upon the frame. The main body also has two spaced apart parallel longitudinal sides 6*a*, 6*b* and two spaced apart parallel ends 6*c*, 6*d*. One longitudinal side, the first side 6*a* includes a disconnect 7 and an interface 8. The disconnect stops the operation of the heater under normal or emergency conditions while the interface allows the operator to start the heater and to regulate the heater during usage. Opposite the first side, the heater has a second side 6*b* later shown in FIG. 4.

Figure 3:
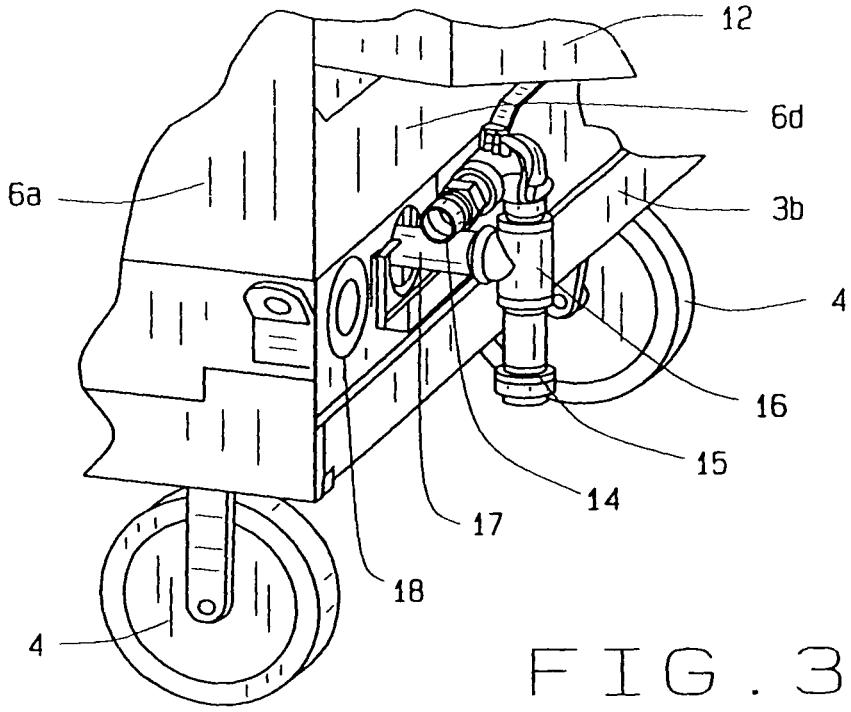
FIG. 3 is a detailed view of the gas connection.

Perpendicular to the sides, the heater one end, the first end 6*c* allows the invention to draw fresh air into it. The first end has a generally planar shape and is at least partially open to the interior of the invention. The preferred embodiment has a rain hood 9 pivotally connect to the first end opposite the frame. The rain hood includes two spaced apart flaps 9*a* that extend generally coplanar to the sides 6*a*, 6*b*. Secured to the sides but above the rain hood, the invention includes a handle 11 extending across the width of the invention. Opposite the first end 6*c*, the heater 2 has its second end 6*d* generally to the right of the interface here in FIG. 2. The second end is generally planar and closed for at least part of its height. The second end includes a diffuser 12 extending outwardly from the second end away from the heater and with its own height less than that of the heater. The diffuser divides and delivers heated air from the invention into ducting, tubes, and the like for delivery throughout a structure. In this figure, the preferred embodiment has a diffuser with four openings 12*a*, generally round in shape, that receives a tube or other distribution means. The diffuser has a somewhat polygonal shape defined by the number of openings 12*a*. Beneath the diffuser and proximate to the frame, the second end includes the beginning of the gas train 13 as shown in FIG. 3. Mutually parallel and spaced above the frame, the invention has a top 10 also of rectangular shape joining the first side 6*a*, the second side 6*b*, the first end 6*c*, the rain hood 9, the second end 6*d*, and the diffuser 12.

FIG. 3 shows a detailed view of the gas train outside of the second end 6*d*. The gas train begins with a quick connect coupling 14, a handle associated with a manual shutoff valve 20, as later shown, from a drip tube 15 with a T connector 16 to a line 17 into the invention. The gas train can accept both natural gas and liquid propane. The line 17 enters the end 3*d* of the frame. Adjacent to the line entry, the heater 2 includes a power inlet 18 for supplying electrical power to the invention, generally 240 volts. The power inlet can have the form of a junction box, twist lock connector, or a socket that receives a plug.

Figure 4:
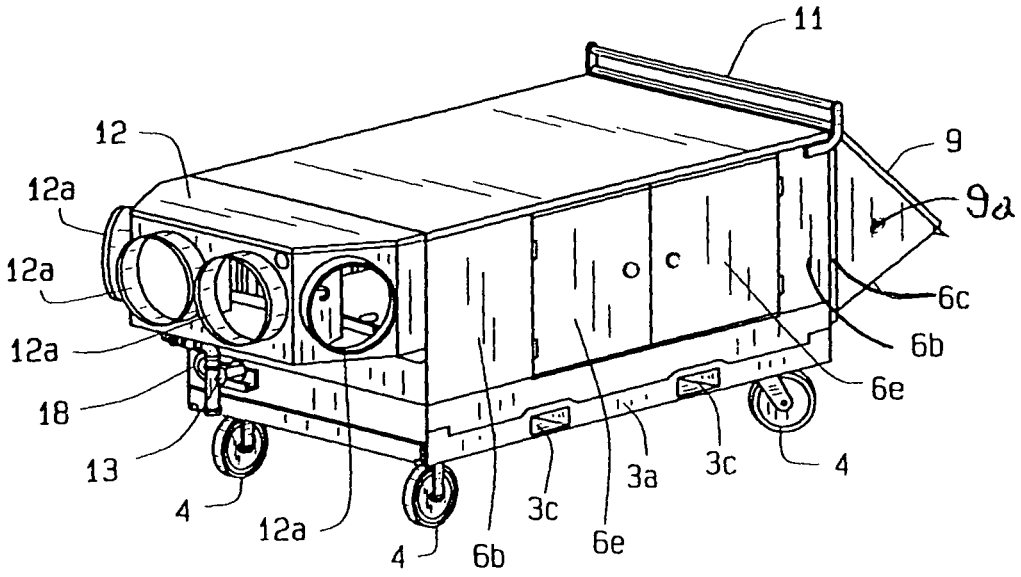
FIG. 4 illustrates an isometric view of the present invention from the opposite direction as in FIG. 2.

Turning the invention 2 slightly from FIG. 2, FIG. 4 shows another perspective view primarily of the second side 6*b*. Above the frame 3 and the longitudinal side 3*a*, the second side is generally planar and has two doors 6*e*, or access panels unlike the disconnect 7 and interface 8 shown on the first side in FIG. 2. The second side is mutually parallel and spaced apart from the first side while being generally perpendicular to the plane of the frame 3. In the preferred embodiment, the pockets 3*c* extend across the width of the frame and through both sides 3*a*. As before, the frame has a caster 4 at each corner, the beginning of the gas train 13 at the second end 6*d* with a diffuser 12 above that, and the rain hood 9 at the opposite first end 6*c*. Here as in FIG. 2 the rain hood is shown opened which permits the air to flow into the heater.

Figure 5:
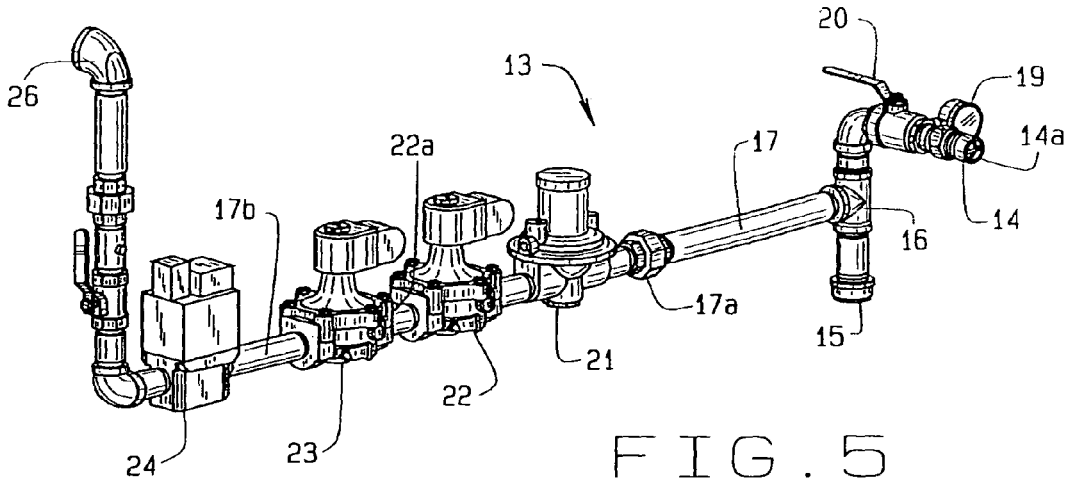
FIG. 5 is a detailed view of the components of the gas train.

Opposite the rain hood 9, FIG. 5 shows the gas train 13 that delivers fuel for combustion inside the heater. The gas train begins with an inlet 14 that receives fuel from a source such as a natural gas line or a liquid propane tank, not shown. The inlet then connects in line with a male disconnect fitting as at 14*a*. Inwardly from the disconnect fitting, the gas train has a supply pressure gauge 19 that provides a reading of the pressure in the fuel entering the invention. The pressure gauge provides readings in psi, kPa, and like units. Inwardly from the supply gage, the disconnect fitting includes a manual shut off valve 20 with a handle that turns the valve ninety degrees to prevent the flow of fuel gas into the invention. The manual shut off valve then connects with a tee 16 positioned below and perpendicular to the manual shut off valve. Beneath the tee, the gas train includes a drip leg 15 with a removable cap that collects any particulates from the fuel gas and rust flakes from the gas train. The drip leg and disconnect fitting are generally collinear upon the tee 16. Perpendicular to the tee 16, the gas train delivers fuel into the invention, as previously shown, through the line 17. This line 17 is generally perpendicular to the drip leg and to the supply inlet as shown. The line has two ends, one connecting to the tee and an opposite second end connecting to a union 17*a*. The union then connects the line to an appliance regulator 21 that delivers fuel gas at the proper pressure for the heater regardless of the supply pressure. In line from the appliance regulator is another shut off valve 22. This shut off valve 22 is an automatic valve electrically controlled unlike the valve attached to handle 20. Down line from the shut off valve 22, the valve includes a tap 22*a* useful for leak testing. Then down line from the tap, the gas train has a safety shut off valve 23. This valve 23 is also an automatic valve. The safety shut off valve 23 closes the gas train in parallel with the previous valve 22, redundantly to insure the stoppage of gas flow to the burner of the invention. Down line from the safety shut off valve 23, the gas train continues away from the inlet 18 with an additional segment of line as at 17*b*. The segment delivers fuel gas to a modulating valve 24. The modulating valve generally ignites a burner of the invention at one fixed firing rate which enhances the reliability of the burner ignition over the prior art systems where ignition occurs over a broader firing rate. As later shown in FIGS. 10-14, the modulating valve adjusts its onboard variable resistors so that the voltage signal of the modulating valve has the precision necessary to achieve the gas flow for a low fire start as later described. The gas train exits the modulating valve 24 into an elbow that directs the gas train generally parallel to the drip leg 15 and the line 17. This last portion of the gas train includes a manual shutoff valve 25 similar to the valve as at 20. The manual shutoff valve 25 and the valve as at 20, when both are closed, isolate the various valves and regulator from the flow of fuel gas so that they can be inspected, maintained, or replaced. After the valve 25, the gas train continues upwardly, that is parallel to the second end 6*d* and after a final elbow 26, the gas train delivers fuel gas at the proper pressure and volume for ignition in the burner of the invention as later shown.

Figure 6:
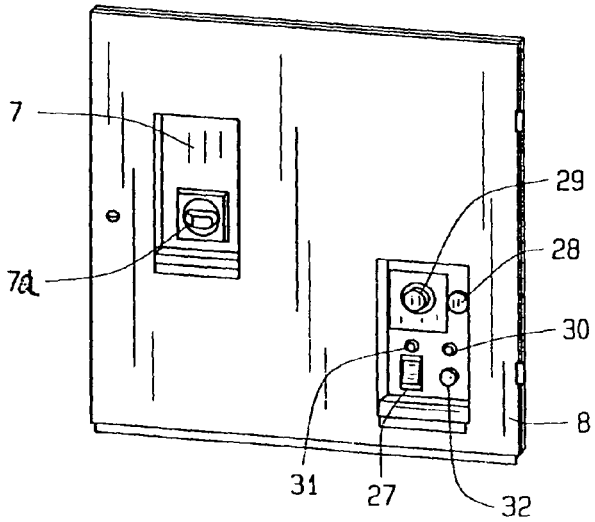
FIG. 6 shows the operator interface of the present invention.

As first described in FIG. 2, the heater 2 includes a disconnect 7 and an interface 8 shown in more detail in FIG. 6. The disconnect has a handle 7*a* that allows an operator to turn the disconnect and stop delivery of electrical power to the invention. An operator access the handle from outside of the invention. Proximate to the disconnect, here shown slightly lower, the invention has the interface 8 with additional controls. The interface includes a burner switch 27 that turns the burner on and off by enabling and disabling electrical ignition of the fuel gas and a fuel select switch 28 that notifies the burner and the valves of the gas train of the type of fuel used either natural gas or liquid propane. The interface also includes a temperature selector dial 29 that allows an operator to adjust the exhaust air temperature as it exits the diffuser 12 by raising and lowering the burner temperature, a burner on light 30 that shows green when the burner combusts natural gas as fuel, a burner on light 31 that shows red when the burner is operating, such as when it combusts liquid propane as its fuel, and an air volume control 32 that allows an operator to adjust the volume of air exiting the diffuser.

Figure 7:
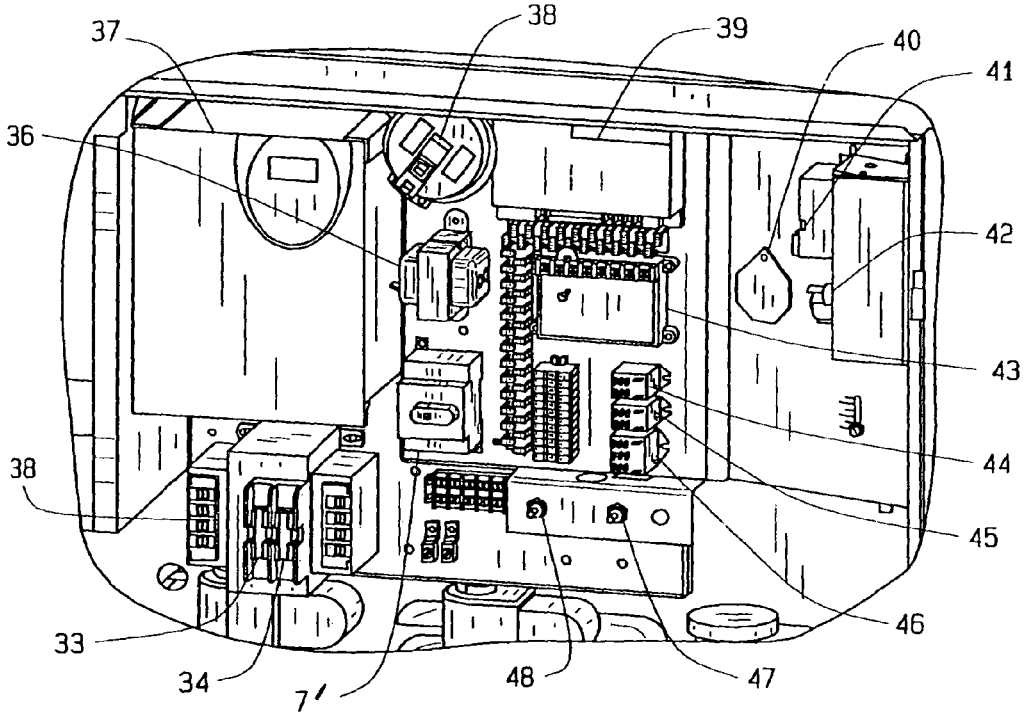
FIG. 7 shows a detailed view of the electrical controls of the present invention.

Behind an access door, similar to 6*e*, and approximately to the left of the disconnect 7 shown in FIG. 2; the heater has various electrical and operational controls shown in FIG. 7. These controls operate the heater upon signals from the operator through the burner switch, fuel selection, and temperature selection and from the safety valves of the gas train previously described. The controls shown here begin with another disconnect 7' that interrupts electrical power to the various controls. The controls also have electrical protection from a first control fuse 33 and a second control fuse 34. The fuses are arranged in parallel and protect separate groups of the controls. These controls receive stepped down power from a control transformer 35. The control transformer lowers the voltage from the line level of 240V to a level for the controls of 120V and 24V. In the figure, the controls have a second transformer 36 locating above the disconnect 7'. The second transformer is at least a class II and lowers the voltage for the controls proximate this transformer. Outwardly from the second transformer and above the control fuse, the controls include a variable frequency drive 37. The drive 37 matches the desired airflow volume of the heater 2 to the requirements of the structure being treated and dried. For instance, a smaller room or space will generally require less airflow and the drive 37 lowers the speed of a fan as later described. Above the second transformer in the figure, the controls include an airflow switch 38 that monitors the flow of air for ignition and then later during operational heating of air produced by the fan under control of the variable frequency drive. In coordination with the airflow switch 38, the controls shown here include a flame safeguard relay 39. This relay monitors electrical power to the ignition device and the fuel gas valves to provide a flame that ignites the burner and monitors the presence of flames in coordination with the air flow from the variable frequency drive.

Outwardly from the flame safeguard relay, the heater controls include a peephole 40 through the hull of the heater that allows an operator to inspect the existence and status of the flame. Proximate the peephole, the controls shown here include a discharge temperature sensor 41 that measures the temperature of the airflow just before entering the diffuser 12. The sensor also cooperates with a high temperature limit 42. The limit has a setting of the maximum temperature permitted for the diffused air. The limit has its setting that avoids burning a person adjacent to the diffuser. The various controls described here in FIG. 7 supply their electrical signals to an amplifier 43 that raises the signals to a common minimum level so that the controls can intercommunicate and regulate the operations of the heater. The controls also include a first control relay 44 and a second control relay 45. Each relay sends the signals from its portion of the controls shown in this figure. As previously mentioned, the heater includes a fuel selector, as at 28 in FIG. 6. The selector sends its signal to the fuel selector relay 46. The relay then provides a signal about the fuel type to the various controls, particularly those of the burner. Beneath the relays in the figure, the controls include a leak test switch 47 that allows for field verification of the integrity of the gas train as shown in FIG. 5. And the controls of FIG. 7 have a blower override switch 48 that allows an operator to shutdown the fan or blower of the heater by interrupting electrical power to the blower.

Figure 8:
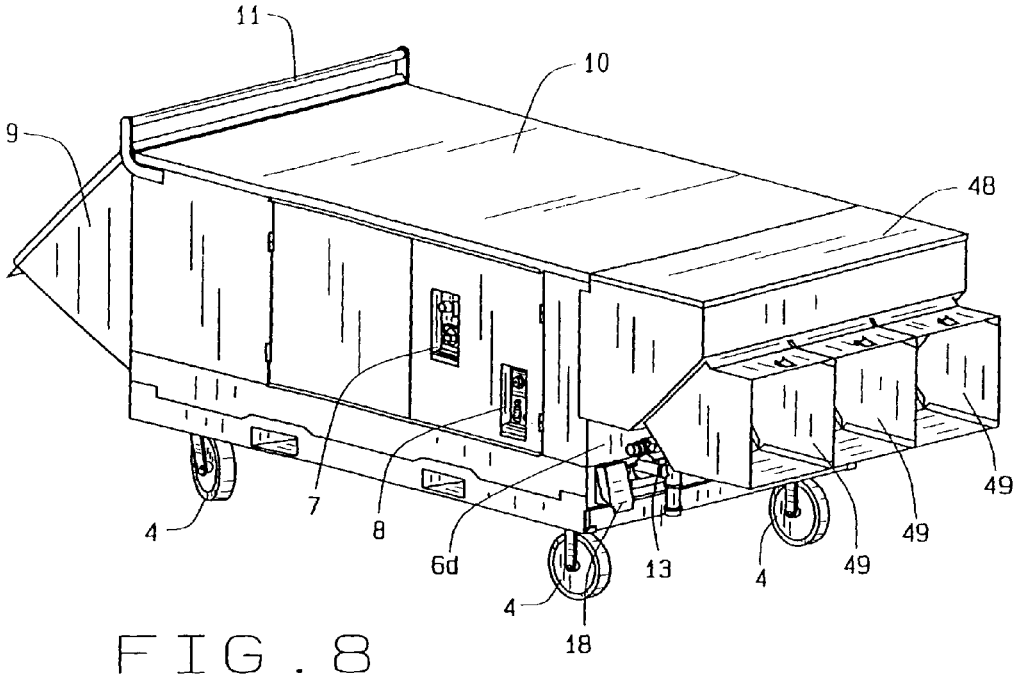
FIG. 8 illustrates an isometric view of an alternate embodiment of the present invention.

The heater includes a diffuser 12 as initially mentioned in FIG. 2. However, FIG. 8 shows an alternate form of the diffuser that begins as a box 48. The box is generally coplanar with the top 10 and extends outwardly from the second end 6*d*. The box has a truncated prismatic shape where the lower right corner of the box is at a bevel to the plane of the second end. The beveled surface of the box is generally open and connects with three chutes 49 that allow for air flow from the diffuser outwardly from the heater. The chutes have a generally rectangular shape for release of heated air into the immediate vicinity of the device or alternately for connection of a metal adapter for connection of flex duct and flexible ducting as shown before and site built ductwork using existing sheet metal techniques.

Figure 9:
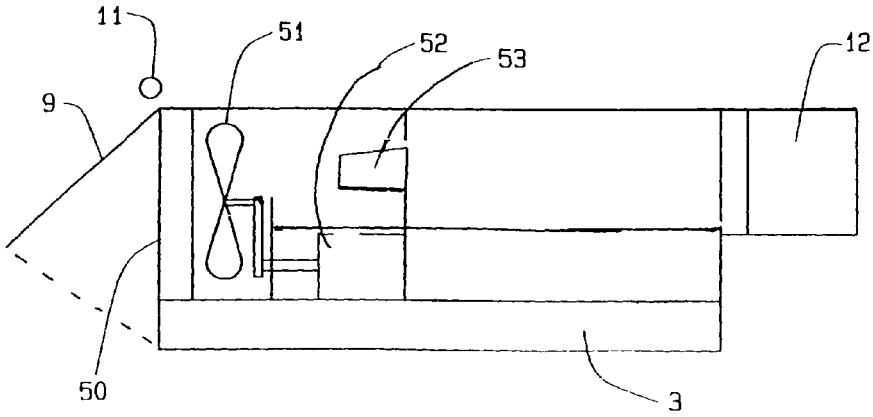
FIG. 9 describes a lengthwise sectional view of the present invention.

The heater 2 of the invention had its initial exterior description in FIG. 2. Looking inside the heater, FIG. 9 provides a longitudinal sectional view through the heater. As before, the heater has a frame 3 to which the remainder of the invention secures. From the left in this figure, the heater has the rain hood 9 extending outwardly and downwardly from the top 10 of the heater. Above the connection of the rain hood to the top, the heater includes a handle 11 that has a diameter suitable for an operator to grip. Inwardly from the rain hood, the heater has an air inlet 50 of the width and the height of the heater. In the preferred embodiment, the air inlet includes a grill or other screen. In alternate embodiments, the air inlet includes a dust filter. The heater includes a blower 51 that occupies a compartment of the heater generally for the width and the height of the heater above the frame. The blower can be a fan with at least two blades or a squirrel cage with a plurality of parallel blades spaced along two perimeter rings. The blower is preferably a backward inclined fan. Although the backward inclined fan overcomes the pressure loss of the discharge ducting, out from the diffuser 12, while maintaining a high flow condition, a forward curve fan may also be used in this invention by selecting larger diameter ducting size to minimize the pressure loss for the desired airflow rate. The blower is monitored by the airflow switch 38 and controlled by the override switch 48 as previously described. A motor 52 turns the blower preferably using a belt driven upon a pulley extending from the motor's shaft. The motor receives speed command and control from the variable frequency drive 37. Alternatively, the blower has a motor directly behind the center of the fan though that affects air flow.

The invention also has the blower positioned in the heater 2 ahead of a burner 53 in a "Blow-Thru" arrangement. The burner is controlled by the switch 27 and other flame controls described in FIG. 7. This arrangement of the motor and the fan positions them out of the heated air stream, thereby, extending their longevity. Alternatively, the fan has its placement after the burner in a "Draw-Thru" configuration; however, the fan, its bearings, drive belts, temperature controls and motor 52 would then endure high temperatures and their detrimental effects over time.

In addition, the location relationship of the fan to the burner has a significant impact on the pounds of air moved by the fan. The preferred embodiment has the Blow-thru design which handles outside air with densities between 0.08635 and 0.07089 pounds per cubic foot over an outdoor ambient temperature span of 0 to 100° F., respectively, for sea level conditions. The alternate embodiment has the Draw-thru design that handles heated air with densities between 0.06856 and 0.06022 pounds per cubic foot over a discharge air temperature span of 120 to 200° F. for sea level conditions.

The following example shows the benefits of the Blow-thru design over the Draw-thru design. For a Blow-thru heater operating at 6000 cfm in a 40° F. ambient and discharging 180° F. (140° F. rise), the heater has a gas input capacity of 1,047,638 Btu/hr and delivers 28,584 pound of air to the space. Under the same conditions, a Draw-thru heater has a gas input capacity of 818,467 Btu/hr and delivers only 22,317 pounds of air to the space.

Based on the differences in air densities handled by the fan (0.0794 pounds per cubic foot for the Blow-thru and 0.0620 pounds per cubic foot for the Draw-thru), the airflow capacity of the fan requires a 128% increase in the Draw-thru to convey the same amount of heating capacity and mass of heated air to the structure necessary to achieve the same drying performance as the Blow-thru arrangement of the invention. The Draw-thru arrangement also calls for larger, heavier, and bulkier equipment to accomplish the same job as the Blow-thru arrangement.

This invention also has the variable frequency drive 37 in the preferred embodiment. The drive provides a more precise match of the desired airflow volume of the heater to the requirements of the structure being treated. A smaller structure will generally require less airflow. In addition, the drive also saves energy during operation as later described.

As previously shown, the heater 2 in the preferred embodiment also includes a discharge diffuser 12 attached to the outlet of the heater that provides for the attachment of either two, three or four flexible ducts with provisions included to block either two, one or none of the openings, respectively, depending on the requirements of the application.

The heater 2 can be moved from one job to the next during its use for drying buildings. However, the heater may also permanently install for moisture removal for a repeated or continuous process or when the items for drying are brought to a specific location for treatment. As shown previously, where the heater is moved, the casters 4 make the invention portable and easily handled by an operator.

Additionally, the heater, particularly the burner, operates on natural gas, propane, or liquefied petroleum (LP) gas as available at the jobsite. The design of the burner 53 allows for proper operation on both fuels without generating carbon monoxide (CO) or other combustion products beyond levels permitted in the ANSI Standard for Construction Heaters. Specifically, the size of the burner orifices have been optimized for both fuels in conjunction with the configuration of slots in the burner tiers and air balancing baffles to minimize the creation of the CO and other combustion products, such as nitrogen dioxide ($NO_2$).

The firing rate of the burner 53 depends on the manifold pressure for the fuel gas. Natural gas operates at a higher manifold pressure than LP because of its lower heat content. This occurs because the orifices on the manifold do not change with respect to the selected gas and the heat content for LP gas is nearly 2½ that of natural gas. The preferred embodiment of the invention has little if any need for manual adjustments to the heater because of the fuel selected, i.e. the setting of the appliance regulator remains the same and the gas train 13 lacks manual devices such as a two ported firing valve that alters the fuel flow via an additional pressure drop in the gas train. The heater of this invention is as fool-proof as possible because of the limited technical skills and lack of familiarity of this type of equipment by the operator that deploys the heater to dry a structure. Toward that goal, the heater includes the discharge temperature control 41 that monitors the discharge temperature and limited its range based on the inlet air temperature to the heater so as not to exceed the gas capacity rating of the invention, as expressed by the temperature rise from the outdoor ambient air temperature to the discharge temperature of the diffuser. This electronic device provides an output to a modulating valve that restricts the gas flow as the temperature rise through the heater approaches the limit (maximum temperature rise), as at 42, established for the invention and permitted by an independent product certification organization. The function of this algorithm cooperates with another algorithm that controls the discharge temperature of the heater. In the preferred embodiment, the discharge temperature algorithm has been "tuned" to ramp the discharge temperature slowly by means of limiting the rate of change of the control output to the modulating valve on start-up or during periods when the airflow through the heater has been changed by the operator. This ramping period has greater duration to purposely avoid any overshooting of the desired discharge temperature.

In the process of removing moisture from a flooded facility or from the materials which were subjected to this excessive moisture condition, the heated air has to be hot enough to drive evaporation. As water evaporates, Btu's have to be added to offset the cooling effect of evaporation and to raise the room temperature. Normally in a building subjected to a high air change rate (over 25 air changes per hour), the high discharge temperature air rapidly heats the air of a dry structure, however, because of the evaporation, it takes much longer for the room air temperature to reach the desired level. The graph below indicates the time relationship of a dryout application of a hypothetical building with respect to room temperature versus time and the related discharge temperature of the heater. This graph also depicts how the grains of moisture leaving the facility increase with time initially and then decrease as the dryout process continues. A larger building, or a building with significantly more moisture, will extend the time period to achieve the desired temperature. An element of the preferred embodiment of this invention provides for a control system that automatically modulates the discharge temperature of the heater as the room temperature or the temperature of the air purged from the structure approaches the desired setpoint. This control system lowers the risk of overheating the space and causing damage to the contents or the structure and further allows for the process to run unattended, without manpower allocated to continuously monitor the drying progress, thereby minimizing the dryout expense.

Figure 17:
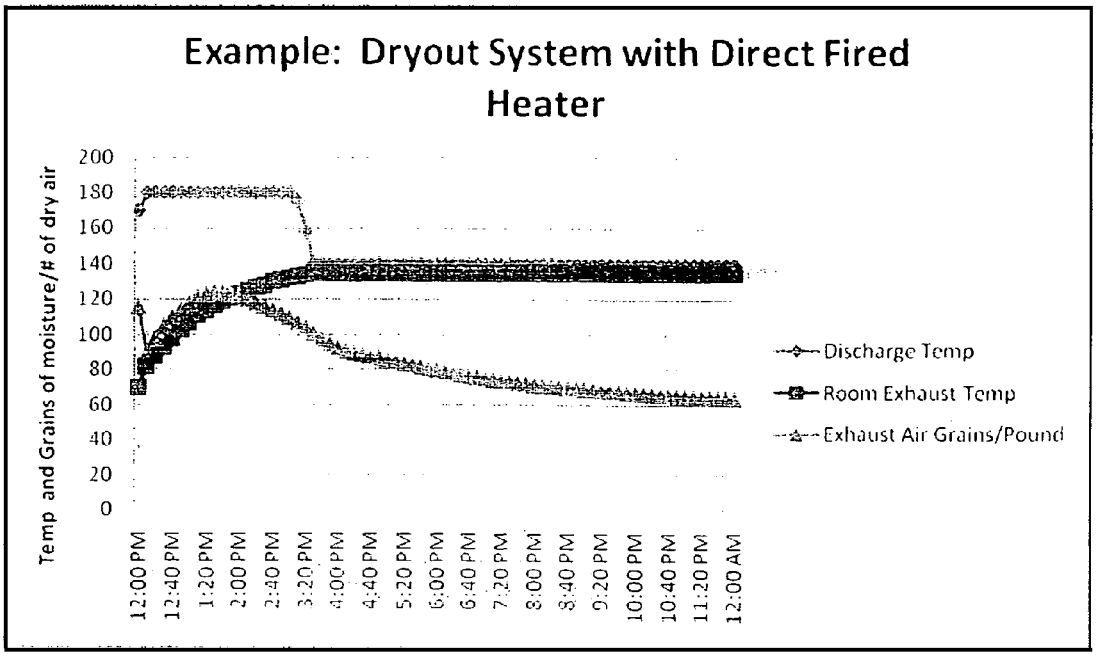
FIG. 17 provides a graph showing the effects of the dry out system with direct fired heater.

FIG. 17 shows graph 1, which is an example of a dry-out system utilizing a direct-fired heater.

Professionals in the water dryout industry have indicated that their goal in drying out flooded structures is to reduce the grains of moisture measurement in the structure to a range from 45 to 55. They cautioned against lowering the grain level below this range because severe damage to wood floors, wood doors, decorative wood trim and furniture has been experienced when the readings are taken much below these levels. As addressed earlier, the moisture from combustion actually adds to the moisture contained in the outside air at the 180° F. discharge temperature and was delivered to the structure with 46.4 grains of moisture per pound of dry air. This moisture level supplied to the structure becomes the limitation of dryness achievable for this drying process. Using the data from the FIG. 17 for the end of the process at the discharge temperature of 140° F., the grains of moisture added was 39.4 per pound of air delivered to the space. The building can only approach dryness level delivered to the space, thereby providing the operator, or dryout specialist, assurance of not over drying the structure to the point of damaging either the structure or its contents.

Figure 18:
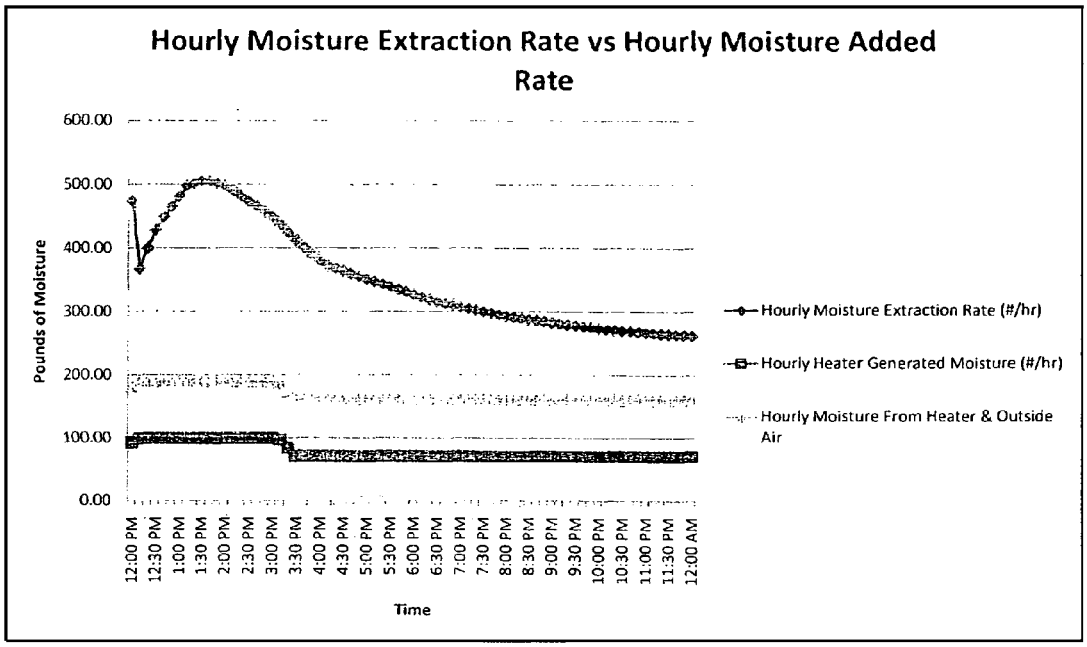
FIG. 18 provides a graph of an hourly moisture extraction rate for the invention.

FIG. 18 demonstrates this relationship. The grains of moisture from FIG. 17 now reflects the pounds of air provided by the heater and the resulting rate of pounds of moisture that is delivered to the space by the combustion process and the outside air along with the pounds of moisture per hour that is being exhausted from the structure. From this hypothetical example, the moisture extracted from the facility increases to the rate of over 500 pounds per hour when less than 200 pounds per hour is supplied from the gas fired heater and outside air or approximately 310 net pounds of water per hour are removed from the structure.

FIG. 18 is a graph No. 2, showing moisture extracted in relationship with moisture added from the hearer and outside air.

From FIG. 17, the evaporation rate has peaked by the time the temperature of the exfiltration air reaches 120° F. at approximately an hour and a half into the process. This time is a function of the presence and volume of standing water in the flooded structure. Even though the temperature in the structure increases, the evaporation rate slows because of the moisture embedded in the contents and building materials of the structure. At approximately 3 hours into the process, the temperature of the exhaust air reaches the desired setpoint and the discharge temperature modulates down to maintain the exiting air temperature. The pace of the evaporation again slows reflective of the lowered discharge temperature. During the 12 hour representation of an actual dryout project, over 4200 pounds of moisture exited the structure compared to approximately 2000 pounds of moisture that was delivered to the space by the heater (combustion and outside air). The actual net amount of moisture from the flooded space exceeds 2200 pounds. This is thought to be in excess of three times the amount that would have been removed by the prior art related to indirect fired heaters and dehumidifier systems. In an actual drying project, the process will continue until the exiting moisture content fell to approximately 50 grains of moisture per pound of air. As an estimate, this will require an additional 12 to 18 hours (or a total of 24 to 30 hours) to achieve under the assumptions of this example. Dryout professionals have indicated that their current process would have taken three to four days to achieve the same results.

The temperatures presented in this specification have not been optimized to achieve the best drying performance possible but rather the Applicants foresee further adjustments of burner temperature during usage of the invention in field conditions. If the initial discharge temperature or the desired setpoint rises, the end point will be achieved faster. Empirical testing during usage will provide for optimization of temperatures in this invention.

Figure 19:
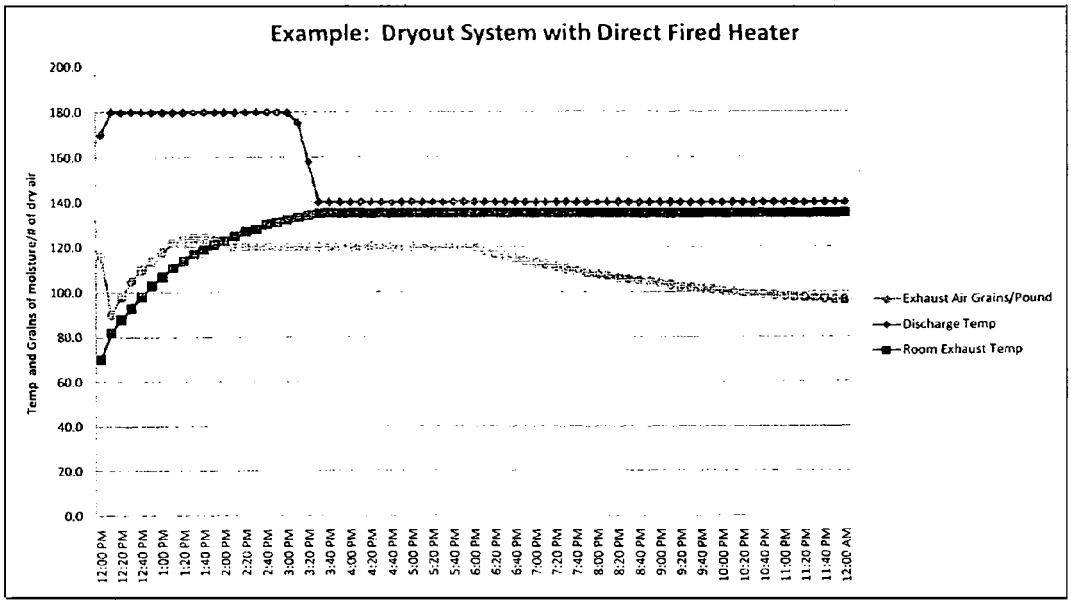
FIG. 19 provides a graph of the dry out system with direct fired heater.

As indicated previously, the variable frequency drive 37 can significantly reduce the energy needed for water dryout and moisture extraction through its controls that monitor the moisture content of the air in the space, or being purged from the facility, by automatically reducing the speed of the fan as the moisture level starts to fall off. The reduction in fan speed reduces the mass of air that is handled by the fan, which saves electrical energy, and reduces the amount of air that is being heated, which saves on the fuel consumed while maintaining the desired outlet air temperature at the diffuser 12. The following FIG. 19 shows the impact of this control system on the example presented in FIG. 17. The grains of moisture are allowed to increase to the specified setpoint and the airflow is gradually reduced to the minimum allowed by the limitations of the invention. When the heater reaches minimum airflow, the grains of moisture will again continue to decline as the facility dries out to eventually approach the net amount being brought in. In this example, the gas capacity was reduced from 748,000 Btu/hr to 498,000. Btu/hr as the airflow was reduced from 6,000 cfm to 4,000 cfm. The motor horsepower declined from 5 horsepower to approximately 1½ horsepower which equates to a current reduction from approximately 28 amps to 10 amps.

FIG. 19 is graph No. 3, showing the dry-out system with direct-fired heater.

Another function in the preferred embodiment automatically controls the heater in the drying project as it monitors the grains of moisture exiting the structure or present in the space and compares it to the desired outcome of the process (i.e. 50 grains of moisture per pound of dry air) and then shut off the heater. This feature allows for the equipment to operate unmanned to the point of achieving the desired dryness.

Because the parameters of outlet air temperature, moisture content of the outside air and the firing rate of the heater all vary during the process and the combination of these parameters may experience periods of time or conditions for which the total grains of moisture of the combustion process and the grains of moisture of the outside air exceed the desired outcome of the drying process, an alternate control solution measures the moisture content of the discharge air from the heater and compares it to the moisture content of the air exiting the structure or the room to shut off the heater 2 when the differential approaches a predetermined level of moisture content (i.e. 5 to 10 grains). The Applicants foresee adding a time element into the control algorithms to effectuate shutdown, via disconnect 7' or blower override 38, should the conditions stabilize for a specified time. This avoids unnecessarily long periods of operation when the moisture content levels asymptotically approach the end point.

Accurately measuring the moisture content of the heated discharge air challenges some of the prior art controls. Yet another alternate means for controlling the operation of the drying project include an algorithm that calculates the moisture from the combustion process based on the heater capacity and adds that level to the moisture content of the outside air for comparison to the moisture content of the exiting air or room air to again shut off the heating equipment as it achieves the desired differential moisture content. This algorithm and control may or may not use a time function that would detect stabilization of the conditions.

The preferred embodiment includes different control circuit methodologies which provide a means for achieving a low fire start condition which is elevated above the minimum firing rate for the purpose of igniting gas for a direct fired burner using a direct ignition system as the ignition source and detecting the presence of flame at a point that is as remote as possible from the ignition source within the flame establishing time period. The essence of this coverage merely leaves the power off to the modulating valve and adjusts the minimum firing rate high enough to achieve ignition and flame detection within the flame establishing time period which has the unacceptable secondary negative effect of raising the minimum temperature rise through the heater which likely overheats the space during mild or moderate ambient weather conditions.

There are six basic variations of control operations for setting up the low fire condition necessary to achieve the desired ignition performance on direct ignition systems contemplated for this invention:

1. Provide a simulated resistance circuit which bypasses the discharge temperature sensors, remote temperature selector, and/or space temperature controls which has the effect of driving the modulating valve to a fixed open setting which can be adjusted by changing the resistance setting of the simulated resistance which in turn changes the valve voltage to open or close the modulation valve to obtain the desired gas flow rate as shown in FIGS. 4 through 6.

2. Provide an isolated DC voltage source which bypasses the normal system voltage input to the modulating valve and has the effect of driving the modulating valve to a fixed open setting which can be adjusted by changing the voltage input to the modulating valve to open or close the modulating valve to obtain the desired gas flow rate as shown in FIGS. 7 through 9.

3. Provide a microprocessor base control system which is capable of driving a stepper motor to a pre-selected number of steps open or closed from a known open or closed position which has the effect of driving the modulating valve to a fixed open setting which can be adjusted in a number of different methods including, but not limited to, selecting the number of step from a given position for the stepper motor to move to open or close the modulating valve to obtain the desired gas flow rate.

4. Provide an intermediate limit switch position which relates to the openness of the modulating valve and which causes the modulating valve to stop at a pre-selected degree of openness in order to obtain the desired gas flow rate. The intermediate limit switch can be mounted on a slide mechanism or adjustable cam means which provides for pre-selected adjustments for adjusting the flow rate through the valve.

5. Provide a modified version of the input parameter provided in design number 3 above which can monitor the output of a variable frequency drive system which has the capability of varying the air flow through the heater and which requires adjustments of the gas flow rate as a function of the specific airflow or speed of the variable frequency drive in as much the relative speed of the heater is tracked and a variable low fire start setting can be adjusted to match the specific air flow present by changing the degree of openness of the modulating valve by counting the number of steps of the valve from a known open or closed valve position.

6. Provide a bypass gas flow arrangement which can be adjusted to supply the proper flow of gas during the ignition cycle to obtain the desired results.

Each of the bypass arrangements are controlled by a timing circuit which revert back to normal operation after a delay of ten to thirty seconds. Also an energy management system or master heater control system controls the modulation of the gas during heater operation by directly providing an input signal to the modulating valve could be programmed to control the voltage during burner ignition directly so as not to need to use a bypass system.

An inherent benefit of this embodiment is that by igniting the burner at one fixed firing rate, the reliability of the burner ignition is enhanced over the prior art systems where ignition occurs over a broader firing rate.

Figure 10:
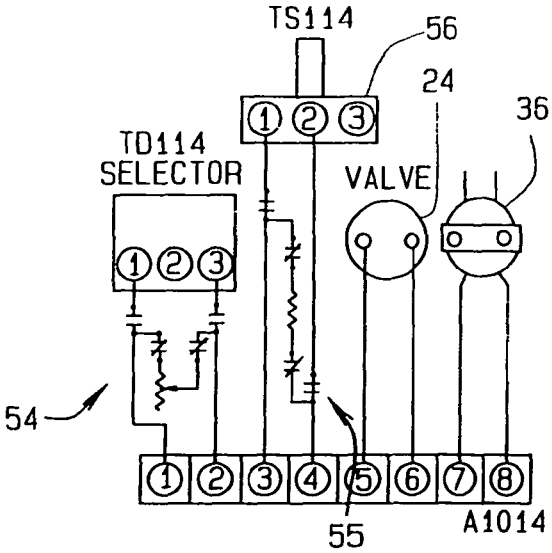
FIG. 10 discloses circuitry for isolating relay contacts for bypassing the discharge temperature selector resistance and the discharge temperature sensor resistance during burner ignition.

FIG. 10 shows isolating relay contacts 54 that bypass the DISCHARGE TEMPERATURE SELECTOR 29 and inserts a variable resistance between terminals 1 and 2 of the A1014 amplifier and a separate set of isolating contacts 55 bypasses the DUCT SENSOR 56 and inserts a fixed resistor between terminals 3 and 4 of the A1014 amplifier. By adjusting the variable resistor connected between terminals 1 and 2, the voltage signal to the modulating valve 24 can be precisely set to the voltage necessary to achieve the gas flow desired to satisfy the requirements of the low fire start function.

Figure 11:
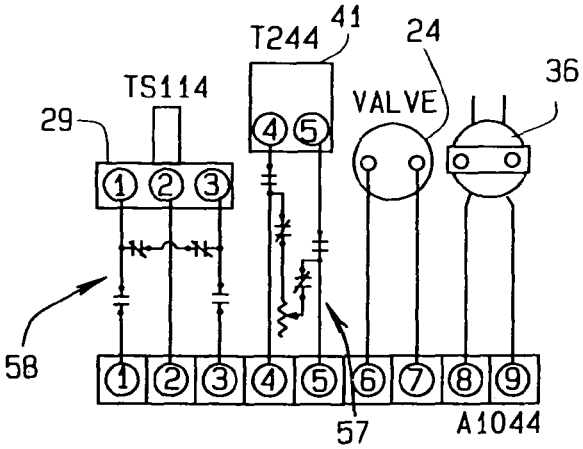
FIG. 11 discloses isolating relay contacts for bypassing the discharge temperature through the use of short circuitry, and for bypassing the space temperature sensor resistance.

FIG. 11 then has isolating relay contacts 57 that bypass the DISCHARGE TEMPERATURE SENSOR 41 and inserts a short circuit between terminals 1 and 3 of the A1044 amplifier and a separate set of isolating contacts 58 bypasses the ROOM TEMPERATURE SELECTOR 29 and inserts a variable resistor between terminals 4 and 5 of the A1044 amplifier. By adjusting the variable resistor connected between terminals 4 and 5, the voltage signal to the modulating valve 24 can be precisely set to the voltage necessary to achieve the gas flow desired to satisfy the requirements of the low fire start function as it is defined in this document.

Figure 12:
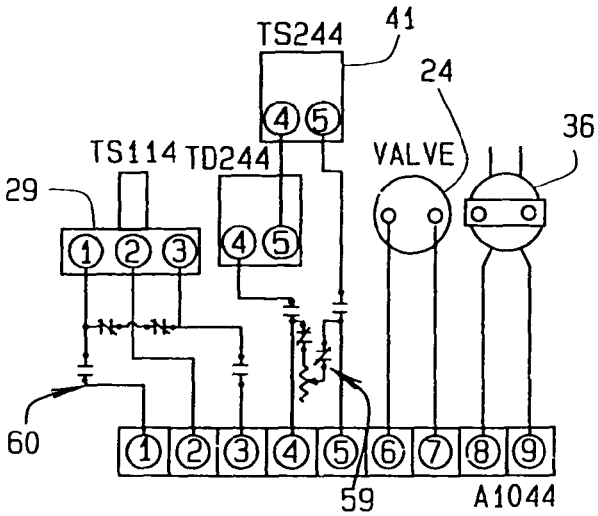
FIG. 12 discloses an isolating relay contact for bypassing the discharge temperature sensor through the use of short circuitry, and for bypassing the resistance combination of the space sensor and space temperature selector.

FIG. 12 once more has isolating relay contacts 59 bypass the DISCHARGE TEMPERATURE SENSOR 41 and insert a short circuit between terminals 1 and 3 of the A1044 amplifier and a separate set of isolating contacts 60 bypasses the ROOM TEMPERATURE SELECTOR 29 and inserts a variable resistor between terminals 4 and 5 of the A1044 amplifier. By adjusting the variable resistor connected between terminals 4 and 5, the voltage signal to the modulating valve 24 can be precisely set to the voltage necessary to achieve the gas flow desired to satisfy the requirements of the low fire start function as it is defined in this document.

Figure 13:
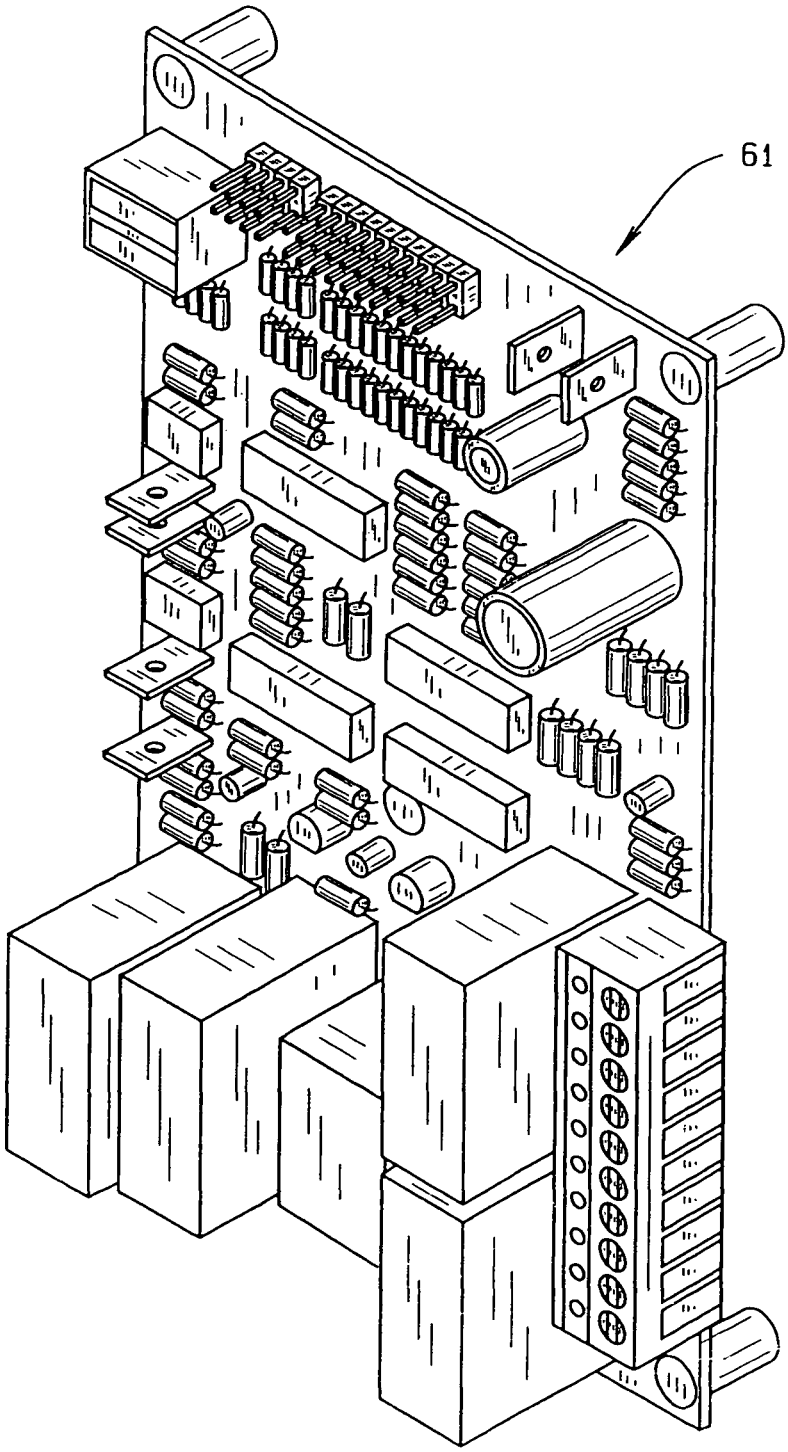
FIG. 13 is a printed circuit board for use in controlling the circuitry of the modulating valve.
Figure 14:
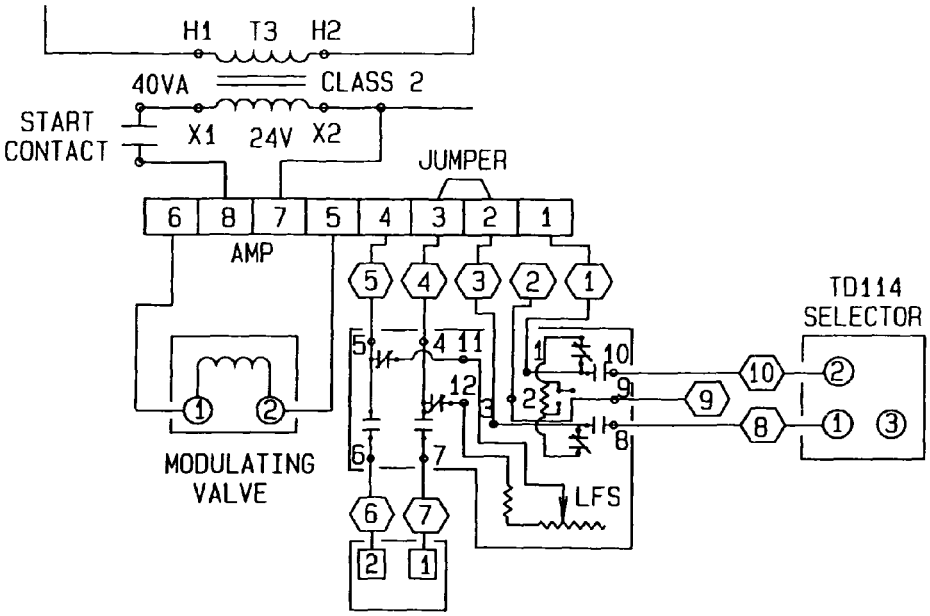
FIG. 14 discloses an electrical circuitry for combining the printed circuit board of FIG. 13 with the various electrical diagrams for circuitry shown in FIG. 10.

FIG. 13 shows a printed circuit board 61 which includes the circuitry needed to accomplish the functions shown in FIGS. 10-12. This circuit board 61 is a component of the controls shown in FIG. 7. While FIG. 14 is a sketch of the electrical connections made between the printed circuit board of FIG. 13 and the modulating valve 24.

Figure 15:
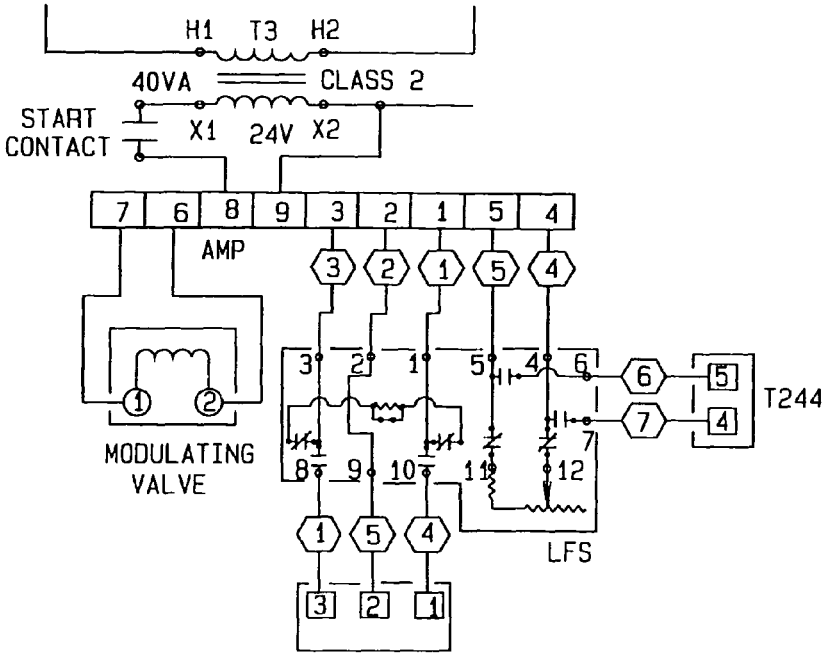
FIG. 15 discloses electrical circuitry for interconnection between the printed circuitry board of FIG. 13 and the electrical circuitry of FIGS. 11, 12.

FIG. 15 is a sketch of the electrical connections made between the printed circuit board of FIG. 13 and the modulating valve 24 where a jumper plug shorts out a fixed resistor between terminals 1 and 3.

Figure 16:
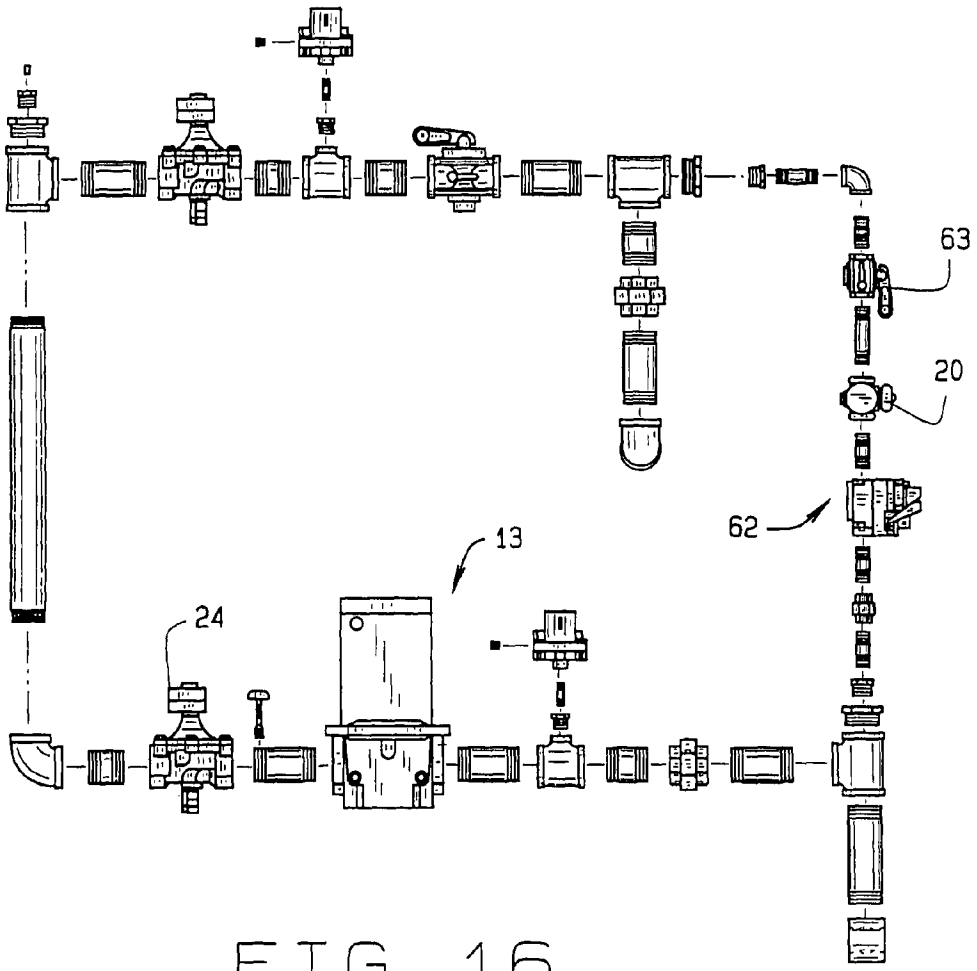
FIG. 16 discloses the bypass gas flow arrangement for adjusting the supply and proper flow of gas during ignition of the burner assembly.

And, FIG. 16 is a drawing of an alternate gas train where a bypass flow circuit 62 provided the low fire start function through the vertical path from the supply connection to the burner manifold. Item 20 on this drawing is the gas shut-off valve and item 63 is the throttling cock for fine tuning the gas flow for the low fire start function. The main gas train 13 still controls the minimum fire by the modulating/regulating valve, 24 in the drawing.

Variations or modifications to the subject matter of this disclosure may occur to those skilled in the art upon reviewing the summary as provided herein, in addition to the description of its preferred embodiments. Such variations or modifications, if within the spirit of this development, are intended to be encompassed within the scope of the invention as described herein. The description of the preferred embodiment as provided, and as show in the drawings, is set forth for illustrative purposes only.

From the aforementioned description, a heater and related controls for extracting moisture and biological organisms from a structure have been described. The heater and controls are uniquely capable of heating air to a low relative humidity for passage through a structure and removal of moisture and biological organisms from the structure. The present invention does not produce noxious or toxic combustion byproducts. The heater and controls and their various components may be manufactured from many materials, including, but not limited to singly or in combination, polymers, polyester, polyethylene, polypropylene, polyvinyl chloride, nylon, ferrous and non-ferrous metals and their alloys, and composites.

We claim:

1. In an open-loop drying system that includes flexible ducting attachable to user-selectable structures present at fixed locations for introducing into enclosed spaces within such structures non-recirculated treated air for effecting removal of moisture from and the drying of the interiors of such enclosed spaces within such structures, wherein such structures are configurable to provide a vent opening to atmosphere and to permit an exchange of air within and the discharge to outside atmosphere of air from such enclosed spaces as the drying system operates in drying mode, a drying system component comprising:

a portable drying device transportable to the fixed location of a given structure and positionable thereat external to such given structure, said drying device separate from such given structure, connectable to the flexible ducting attachable to such given structure, and having communication to the atmosphere, said drying device including:

a cabinet structure;

a heating unit within said cabinet structure;

an inlet portion into said cabinet structure admitting air from the atmosphere;

an outlet portion from said cabinet structure to which the flexible ducting is connectable;

a fan operable to move air through said cabinet structure from said inlet portion towards said heating unit and to said outlet portion;

a control for automatedly controlling operation of said heating unit, said control operable to monitor conditions at the enclosed space and responsive to conditions thereat to control the operation of said heating unit;

said heating unit operable in accordance with said control to controllably heat air being continuously supplied through said inlet portion from outside of the enclosed space during drying mode operation and to raise the temperature and lower the moisture concentration of the supplied atmospheric air to produce treated air;

said drying device operable when so positioned external to said given structure and connected to the flexible ducting to deliver treated air of substantially lower humidity than the air of the atmosphere outside of the structure outwardly from said outlet portion through the flexible tubing into the enclosed space to effect drying of the enclosed space; and whereby introduction of the treated air into the enclosed space effects an evaporation process thereat that causes the moisture content of the treated air delivered into the enclosed space to increase as it moves through the enclosed space toward the vent opening to purge moisture from the enclosed space and to effect changes in the conditions within the enclosed space whereby such changes of conditions within the enclosed space effect changes in the operation of the heating unit to thereby reduce the energy consumption required for the drying process while increasing the speed to accomplish the desired moisture removal.

2. The drying system component of claim 1 wherein said drying device includes:

a frame generally rectangular and planar;

said cabinet structure being mounted upon said frame and being generally hollow and prismatic in shape, having a first side and a spaced apart second side, a first end and an opposite second end, and a top opposite said frame;

wherein:

said heating unit includes a burner that combusts fuel in the presence of said atmospheric air being continuously supplied through said inlet portion from outside of the enclosed space to raise the temperature of the air and lower the moisture concentration of the air following combustion;

said burner combusts substantially all of its fuel so that combustion products remain below standards; and, said drying device delivers air after combustion by said burner at a significantly lower relative humidity than the air of the atmosphere outside of the structure and delivers the air outwardly from said second end into the enclosed space and thus effects drying of the enclosed space.

3. The drying system component of claim 2 wherein said burner combusts one of natural gas, liquefied petroleum gas, or propane at the selection of a user.

4. The drying system component of claim 3 wherein said drying device further includes:

a variable frequency drive associated with said heating unit within said cabinet structure, said burner operating in conjunction with said variable frequency drive and having a high temperature limit.

5. The drying system component of claim 3 wherein:

said fan has an airflow switch regulating the volume of air per minute delivered by said drying device.

6. The drying system component of claim 5 wherein:

said fan is located proximate said inlet portion and before said burner and blows air through said burner.

7. The drying system component of claim 5 wherein:

said fan is located after said burner and before said second end and draws air through said burner.

8. The drying system component of claim 5 wherein said fan admits air into said dryer within the temperature range of approximately 0° F. to approximately 100° F.

9. The drying system component of claim 5 wherein said fan discharges heated air from said dryer within the temperature range of approximately 120° F. to approximately 200° F.

10. The drying system component of claim 5 wherein:

said drying device delivers dried air of at least 45 grains of moisture per pound of air into the enclosed space.

11. The drying system component of claim 10 wherein:

said control regulates operation of said drying device based upon the moisture content of air within the enclosed space and deactivates said drying device when the moisture content of air within the enclosed space reaches less than 50 grains per pound.

12. A method of drying an enclosed space within a user-selectable structure present at a fixed location, wherein such structure is configurable to provide a vent opening to atmosphere and to permit an exchange of air within and the discharge to outside atmosphere of air from such enclosed space as such enclosed space is dried, comprising:

providing an open-loop drying system that includes flexible ducting attachable to the user-selected structure for introducing into the enclosed space within such structure non-recirculated treated air for effecting removal of moisture from and the drying of the interior of such enclosed space within such structure, said system including a portable drying device transportable to the site of such user-selected structure, said drying device including:

a cabinet structure;

a heating unit within said cabinet structure;

an inlet portion into said cabinet structure admitting air from the atmosphere;

an outlet portion from said cabinet structure to which the flexible ducting is connectable;

a fan operable to move air through said cabinet structure from said inlet portion towards said heating unit and to said outlet portion;

a control for controlling operation of said heating unit, said control operable to monitor conditions at the enclosed space and responsive to conditions thereat to control the operation of said heating unit;

said heating unit operable in accordance with said control to controllably heat air being continuously supplied through said inlet portion from outside of the enclosed space during drying mode operation and to raise the temperature and lower the moisture concentration of the supplied atmospheric air to produce treated air;

collecting air from outside of the structure;

delivering the air proximate the heating unit;

heating the air using the heating unit, in accordance with the control, to produce treated air such that the treated air has a significant reduction in its relative humidity compared to the air outside the structure;

delivering the treated air into the structure wherein the treated air absorbs moisture from within the structure; and discharging moisture laden air from the structure to the air outside of the structure.

13. The structure drying method of claim 12 wherein said heating unit includes a burner and said burner operates upon one of natural gas, liquefied petroleum gas, or propane and combusts substantially all of its fuel so that combustion products remain below standards.

14. The structure drying method of claim 13 further comprising:

said delivering of air including positioning said fan before said burner and operating said fan.

15. The structure drying method of claim 13 further comprising:

said delivering of air heated by said burner including positioning said fan after said burner and operating said fan.

16. The structure drying method of claim 13 wherein said method delivers air heated by said burner having a moisture content of at least 45 grains per pound of air.

17. The drying system component of claim 1 wherein:

said drying device communicates from the atmosphere outside of the enclosed space and into the enclosed space and includes:

a rectangular planar frame;

said cabinet structure includes:

a hollow cabinet upon said frame, having two spaced apart sides, two spaced apart ends, and a top opposite said frame and joining to said sides and said ends;

said fan is located within said cabinet and is electrically driven and capable of handling air from approximately 0° F. to approximately 200° F.; and said heating unit includes:

a burner that combusts fuel in the presence of air supplied through said inlet portion from the atmosphere and combusts substantially all of its fuel so that combustion products remain below standards; and wherein said device reduces the moisture concentration in the air following combustion thus encouraging drying of the enclosed space.

18. The structure drying method of claim 17 wherein said burner operates to raise the temperature and lower the moisture concentration of the air proximate thereto to at least 45 grains per pound of air as fuel is combusted.

* * * * *

UNITED STATES PATENT AND TRADEMARK OFFICE

CERTIFICATE OF CORRECTION

PATENT NO. : 8,726,539 B2
APPLICATION NO. : 13/573493
DATED : May 20, 2014
INVENTOR(S) : Gary J. Potter et al.

It is certified that error appears in the above-identified patent and that said Letters Patent is hereby corrected as shown below:

In the Specification

Column 1 lines 6-19, should read as follows

-- CROSS-REFERENCE TO RELATED APPLICATION
This continuation patent application claims priority to the continuation-in-part patent application having Serial No. 12/460,648, filed on July 22, 2009, now Publication No. 2010/0024244; which claims priority to the non-provisional patent application having Serial No. 10/223,556, filed on August 19, 2002, now Patent No. 7,568,908; which claims priority to the continuation patent application having Serial No. 09/574,338, filed on May 20, 2000, now abandoned; which claims priority to the provisional patent application having Serial No. 60/135,067, filed on May 20, 1999, now expired; which are owned by the same inventor. --.

Signed and Sealed this
Twenty-ninth Day of July, 2014

Michelle K. Lee

Michelle K. Lee
*Deputy Director of the United States Patent and Trademark Office*